US011737570B2

(12) United States Patent
Stone et al.

(10) Patent No.: US 11,737,570 B2
(45) Date of Patent: Aug. 29, 2023

(54) APPARATUS FOR SUPPORTING A USER IN A FORWARD-LEANING POSITION WITH BASE PROXIMITY ADJUSTABILITY

(71) Applicant: Hypnap LLC, Waltham, MA (US)

(72) Inventors: Michael Anthony Disimoni Stone, Wilbraham, MA (US); Brian Edward Hack, Somerville, MA (US); Jurgen Paul Frasch, Berlin, MA (US)

(73) Assignee: Hypnap LLC, Waltham, MA (US)

( * ) Notice: Subject to any disclaimer, the term of this patent is extended or adjusted under 35 U.S.C. 154(b) by 125 days.

(21) Appl. No.: 17/445,020

(22) Filed: Aug. 13, 2021

(65) Prior Publication Data

US 2023/0047708 A1 Feb. 16, 2023

(51) Int. Cl.
*A47C 16/00* (2006.01)

(52) U.S. Cl.
CPC ..... *A47C 16/00* (2013.01)

(58) Field of Classification Search
CPC ..... A47C 16/00
USPC ..... 248/118
See application file for complete search history.

(56) References Cited

U.S. PATENT DOCUMENTS

| | | | | |
|---|---|---|---|---|
| 327,816 | A | | 10/1885 | Newbourg |
| 456,089 | A | | 7/1891 | Harrison |
| 1,855,408 | A | | 4/1932 | Montenegro |
| 2,693,400 | A | | 11/1954 | Erickson |
| 3,386,392 | A | | 6/1968 | Gramm |
| 3,625,161 | A | | 12/1971 | Rosner |
| 3,828,377 | A | * | 8/1974 | Fary, Sr. ..... A47C 20/026 5/639 |
| 4,436,271 | A | | 3/1984 | Manso |
| 4,802,708 | A | | 2/1989 | Vos et al. |
| 5,044,026 | A | | 9/1991 | Matthews |
| 5,046,433 | A | | 9/1991 | Kramer et al. |

(Continued)

FOREIGN PATENT DOCUMENTS

| | | | |
|---|---|---|---|
| CN | 202122397 | U | 1/2012 |
| DE | 29802573 | U1 | 6/1998 |

(Continued)

OTHER PUBLICATIONS

G. J. Criner, "4 Secrets to Easier Breathing", Bottom Line Health, Feb. 1, 2014, bottomlinehealth.com/4-secrets-to-easier-breathing.

(Continued)

*Primary Examiner* — Muhammad Ijaz
(74) *Attorney, Agent, or Firm* — Intrinsic Law Corp.

(57) ABSTRACT

An apparatus for supporting a user includes a faceplate, an arm, and a base. The faceplate has an opening to receive a user's face. The arm is attached to the faceplate and the base. The base includes a base slide that is slidable within a slot of a base body. The base slide includes one or more lock pins that releasably engage one of multiple holes in a lock bar. The lock bar is mechanically coupled to a button body. When the button body is pulled distally, the lock bar moves away from the base slide such that the lock pin(s) is/are removed from the corresponding hole(s) to allow the base slide to slide within the slot. When the button body is released, the lock bar moves towards the base slide such that the lock pin(s) is/are inserted into the same or different hole(s) to lock the slide's position.

19 Claims, 29 Drawing Sheets

(56) References Cited

U.S. PATENT DOCUMENTS

| | | | | |
|---|---|---|---|---|
| 5,123,621 | A | 6/1992 | Gates | |
| 5,269,229 | A | 12/1993 | Akapantangkul | |
| 5,330,147 | A | 7/1994 | Volcheff et al. | |
| 5,370,060 | A | 12/1994 | Wang | |
| 5,769,369 | A | 6/1998 | Meinel | |
| 5,797,578 | A | 8/1998 | Graffeo et al. | |
| 5,884,974 | A * | 3/1999 | Bergsten | A47B 21/0371 297/411.36 |
| 6,142,570 | A * | 11/2000 | Bergsten | A47B 21/0371 297/411.37 |
| 6,203,109 | B1 * | 3/2001 | Bergsten | A47B 21/0371 297/411.36 |
| 6,581,226 | B1 | 6/2003 | Brustein | |
| 6,647,573 | B2 | 11/2003 | Corbin | |
| 6,684,431 | B2 * | 2/2004 | Splane, Jr. | A47C 20/026 5/640 |
| 6,758,447 | B2 * | 7/2004 | Tinsley | A61G 13/12 248/118 |
| 6,857,149 | B2 * | 2/2005 | Hoggatt | A47C 20/026 5/652 |
| 7,036,168 | B1 | 5/2006 | Knickerbocker | |
| 7,364,129 | B1 | 4/2008 | Levari, Jr. | |
| 7,669,812 | B2 | 3/2010 | Yun | |
| 7,922,137 | B2 | 4/2011 | Derry et al. | |
| 8,011,731 | B2 | 9/2011 | Goddu | |
| 8,074,951 | B2 | 12/2011 | Carnevali | |
| 8,176,587 | B2 | 5/2012 | Matt et al. | |
| 8,205,283 | B1 | 6/2012 | Russell | |
| 8,387,930 | B2 | 3/2013 | Drew et al. | |
| 8,413,943 | B1 | 4/2013 | Li | |
| D683,463 | S | 5/2013 | Huggins | |
| 8,468,628 | B1 | 6/2013 | Cheng | |
| 8,469,325 | B2 | 6/2013 | Yu | |
| 8,528,978 | B2 | 9/2013 | Purpura et al. | |
| 8,763,969 | B2 | 7/2014 | Wu et al. | |
| 8,814,128 | B2 | 8/2014 | Trinh et al. | |
| 8,925,877 | B2 | 1/2015 | Carnevali | |
| 8,985,693 | B2 | 3/2015 | Purpura et al. | |
| 9,145,158 | B2 | 9/2015 | Cruz | |
| 9,198,507 | B1 | 12/2015 | Lau | |
| 9,226,587 | B2 * | 1/2016 | Halimi | A47C 16/00 |
| 9,448,588 | B2 | 9/2016 | Barnard | |
| 9,568,141 | B1 | 2/2017 | Zaloom | |
| 9,578,979 | B1 | 2/2017 | Zeuch et al. | |
| 9,634,519 | B2 | 4/2017 | King et al. | |
| 9,637,031 | B2 * | 5/2017 | Hill | A47C 20/04 |
| 9,695,849 | B2 | 7/2017 | Zhou et al. | |
| 9,877,588 | B2 | 1/2018 | Belleh | |
| 9,898,042 | B2 | 2/2018 | Abbott | |
| 10,208,777 | B1 | 2/2019 | Brassard | |
| 10,226,130 | B2 * | 3/2019 | Hill | B60N 3/001 |
| 10,322,764 | B2 | 6/2019 | Thomas | |
| 10,426,261 | B2 | 10/2019 | Theis et al. | |
| 10,646,045 | B2 * | 5/2020 | Hill | F16M 13/022 |
| 10,813,451 | B2 * | 10/2020 | Hill | F16M 11/10 |
| D955,586 | S * | 6/2022 | Belleh | D24/184 |
| 11,414,193 | B2 * | 8/2022 | Olson | B60N 2/838 |
| 11,510,490 | B2 | 11/2022 | Hill et al. | |
| 2002/0050009 | A1 * | 5/2002 | Ley | A47C 7/383 5/657 |
| 2002/0100846 | A1 * | 8/2002 | Tinsley | A61G 13/12 248/118 |
| 2003/0164010 | A1 | 9/2003 | Galant | |
| 2003/0172462 | A1 | 9/2003 | Hoggatt et al. | |
| 2008/0269544 | A1 | 10/2008 | Atkin et al. | |
| 2008/0303318 | A1 | 12/2008 | Hamilton | |
| 2009/0236893 | A1 | 9/2009 | Ehlers et al. | |
| 2009/0308990 | A1 | 12/2009 | Yen et al. | |
| 2010/0117435 | A1 | 5/2010 | Samuelsen | |
| 2011/0277238 | A1 | 11/2011 | Mabry | |
| 2012/0074272 | A1 | 3/2012 | Hull | |
| 2012/0119040 | A1 | 5/2012 | Ergun et al. | |
| 2012/0181821 | A1 | 7/2012 | Edalati et al. | |
| 2013/0007961 | A1 | 1/2013 | Noh | |
| 2013/0092805 | A1 | 4/2013 | Funk et al. | |
| 2013/0232696 | A1 * | 9/2013 | Halimi | A47C 16/00 5/640 |
| 2014/0033439 | A1 * | 2/2014 | Berhanu | A47C 16/00 5/640 |
| 2014/0097306 | A1 | 4/2014 | Hale et al. | |
| 2014/0328020 | A1 | 11/2014 | Galant | |
| 2015/0001905 | A1 * | 1/2015 | Jackow | A47C 7/383 297/397 |
| 2015/0034778 | A1 | 2/2015 | Lin et al. | |
| 2015/0123450 | A1 * | 5/2015 | Miller | A47C 16/00 297/488 |
| 2015/0267863 | A1 | 9/2015 | Chang | |
| 2015/0336495 | A1 | 11/2015 | Maslakow | |
| 2016/0108942 | A1 | 4/2016 | Yu | |
| 2016/0120326 | A1 * | 5/2016 | Belleh | B60N 2/806 297/391 |
| 2016/0151221 | A1 | 6/2016 | Mount | |
| 2016/0201359 | A1 | 7/2016 | Berglund et al. | |
| 2016/0312950 | A1 | 10/2016 | Bowman et al. | |
| 2016/0331126 | A1 * | 11/2016 | Mills | F16M 11/26 |
| 2018/0020825 | A1 | 1/2018 | Hung | |
| 2018/0084919 | A1 * | 3/2018 | Rayburn | A47C 7/383 |
| 2018/0317663 | A1 * | 11/2018 | Nam | A61G 13/122 |
| 2019/0125605 | A1 * | 5/2019 | Skursky | A61G 15/007 |
| 2019/0187754 | A1 | 6/2019 | Janzen et al. | |
| 2019/0301665 | A1 | 10/2019 | Wu | |
| 2019/0365092 | A1 | 12/2019 | Zhang | |
| 2019/0376639 | A1 | 12/2019 | Bowman et al. | |
| 2020/0025327 | A1 | 1/2020 | Angsutrarux | |

FOREIGN PATENT DOCUMENTS

| | | | |
|---|---|---|---|
| DE | 102016101331 | A1 | 7/2017 |
| EP | 2359720 | A1 | 8/2011 |
| EP | 2589535 | A1 | 5/2013 |
| EP | 3076266 | A1 | 10/2016 |
| GB | 2569201 | A | 6/2019 |
| WO | 2009108823 | A1 | 9/2009 |
| WO | 2010129652 | A1 | 11/2010 |
| WO | 2010138216 | A1 | 12/2010 |
| WO | 2011066994 | A2 | 6/2011 |

OTHER PUBLICATIONS

E. Dean, "Effect of Body Position on Pulmonary Function", Physical Therapy, May 1985, p. 613-618, vol. 65, No. 5.

L. Martelli-Reid et al., "Labor and birth: 1st Stage of Labor (part 5)—Positions for First Stage of Labor", women.programming4.us/health/labor-and-birth--1st-stage-of-labor-(part5)-positions-for-first-stage-of-labor.aspx#3VQLHcqRwptV32BO.99.

"Getting the air you need: A practical guide to coping with and managing shortness of breath", Juravinski Cancer Centre Information for patients and families, Hamilton Health Sciences, Ontario, Canada.

"Why is exercise important", British Lung Foundation, www.bif.org.uk/Page/Why-is-exercise-important.

Moore et al., "Mind-Body skills for Regulating the Autonomic Nervous System", Jun. 2011, Version 2, Defense Centers of Excellence for Psychological Health & Traumatic Brain Injury, Virginia.

Skyrest, "Skyrest Travel Pillow", sold by Planet Stuff, www.amazon.com/Skyrest-Travel-Pillow/dp/BOOGMQU948.

Ezsnooz, "eZsnooZ All Purpose Travel Cushion", via YouTube, uploaded Jul. 21, 2008, www.youtube.com/watch?v=IEaenYh-jFg.

Eugene, OR Website, "Diaphragm Deep Breathing", www.eugene-or.gov/DocumentCenter/View/14142.

Wikipedia, "Tripod position", Wikipedia, the free encyclopedia.

U.S. International Searching Authority, "International Search Report and Written Opinion of the International Searching Authority, App. No. PCT/US15/24817", dated Jul. 13, 2015, WIPO.

* cited by examiner

APPARATUS FOR SUPPORTING A USER IN A FORWARD-LEANING POSITION WITH BASE PROXIMITY ADJUSTABILITY

TECHNICAL FIELD

This application relates generally to an apparatus for supporting the head and upper body in a forward-leaning position.

BACKGROUND

Sleeping in the seated position is difficult for most people. There are occasions where and reasons why people desire rest and sleep but are unable to avoid the seated position, for example when the person is on an airplane, in a wheelchair, or at an office desk. Also, some people cannot sleep in bed due to back pain or other physical issues. The airline industry has attempted to address this issue by allowing passengers to recline in their seats. However, most economy and business class seats do not recline more than 35 degrees, which most people still find uncomfortable.

SUMMARY

Example embodiments described herein have innovative features, no single one of which is indispensable or solely responsible for their desirable attributes. The following description and drawings set forth certain illustrative implementations of the disclosure in detail, which are indicative of several exemplary ways in which the various principles of the disclosure may be carried out. The illustrative examples, however, are not exhaustive of the many possible embodiments of the disclosure. Without limiting the scope of the claims, some of the advantageous features will now be summarized. Other objects, advantages and novel features of the disclosure will be set forth in the following detailed description of the disclosure when considered in conjunction with the drawings, which are intended to illustrate, not limit, the invention.

An aspect of the invention is directed to an apparatus for supporting a user, comprising: a faceplate having a frame that defines an opening configured to receive a user's face; an arm having opposing first and second ends, the first end attached to the faceplate; and a base. The base comprises: a base body pivotably attached to the second end of the arm, the base body having a base body slot that extends from a distal end towards a proximal end of the base body along a first axis; a lock bar disposed on the base body, the lock bar having a length that is parallel to the first axis and a width that is parallel to a second axis that is orthogonal to the first axis, the lock bar defining a plurality of holes that are spaced along the length of the lock bar, each hole extending through the lock bar parallel to the second axis, the holes defined between opposing inner and outer sides of the lock bar; a base slide configured to slidingly engage the slot, the base slide having a base slide lock pin; and a button body disposed on the base body and a top side of the lock bar, the button body including a button body slot that slidingly engages a lock bar pin that extends from the top side of the lock bar along a third axis that is orthogonal to the first and second axes, the button body slidable between a distal position and a proximal position. The base has (a) a locked state in which the button body is in the proximal position and the base slide lock pin is inserted into one of the holes in the lock bar to prevent the base slide from sliding in the base body slot and (b) an unlocked state in which the button body is in the distal position and the base slide lock pin and the one of the holes in the lock bar are separated to allow the base slide to slide in the base body slot.

In one or more embodiments, the button body slot is oriented in a direction between the first and second axes such that when the button body is in the proximal position, the lock bar is disposed closer to the base slide than when the button body is in the distal position, and when the button body is in the distal position, the lock bar is disposed further from the base slide than when the button body is in the proximal position. In one or more embodiments, a distal end of the button body slot is closer to a center axis of the base than a proximal end of the button body slot, when the button body is in the proximal position, the lock bar pin is in the distal end of the button body slot, and when the button body is in the distal position, the lock bar pin is in the proximal end of the button body slot.

In one or more embodiments, the button body slot is straight. In one or more embodiments, the lock bar defines a row of the holes, the row parallel to the first axis. In one or more embodiments, a raised button is attached to the button body to allow the user to slide the button body parallel to the first axis. In one or more embodiments, the apparatus further comprises a spring attached to the button body and the base body, the spring extending parallel to the first axis, the spring having an expanded state when the button body is in the distal position and a contracted state when the button body is in the proximal position.

In one or more embodiments, the apparatus further comprises a buttress having opposing first and second ends, the first end of the buttress pivotably attached to the arm, the second end of the buttress pivotably attached to the base, and a buttress pin guide disposed on the base body, the buttress pin guide having a buttress pin guide slot that extends parallel to the first axis, the buttress pin guide slot slidingly receiving a buttress lock pin attached at the second end of the buttress, the buttress lock pin extending parallel to the second axis. The lock bar defines first and second rows of the holes, the first and second rows parallel to the first axis, and in the locked state, the base slide lock pin is inserted into one of the holes in the first row and the buttress lock pin is inserted into one of the holes in the second row. In one or more embodiments, in the unlocked state: the base slide lock pin is removed from the one of the holes in the first row and the buttress lock pin is removed from the one of holes in the second row, and the buttress lock pin is slidable along the buttress pin guide slot to move the second end of the buttress along the first axis to thereby adjust an angle of the arm, the angle defined between an arm axis and the first axis, the arm axis extending along a length of the arm, the length measured between the first and second ends of the arm.

In one or more embodiments, the arm is configured to telescope to adjust a length of the arm, the length measured between the first and second ends of the arm. In one or more embodiments, the arm includes upper and lower bodies, the upper body including first and second fingers that slidably contact opposing inner walls, respectively, in the lower body. In one or more embodiments, each opposing inner wall has a scalloped surface comprising an alternating pattern of indentations and rounded ridges, and an outwardly-projecting end of each finger and the indentations have complementary shapes.

In one or more embodiments, the apparatus further comprises a chest support plate having a chest support plate slot defined on a back surface of the chest support plate, the chest support plate slot configured to slide over a ridge on the arm that extends along an arm axis, the arm axis extending along a length of the arm, the length measured between the first and second ends of the arm, whereby a position of the chest support plate along the arm axis is adjustable with respect to the arm. In one or more embodiments, the faceplate is pivotably attached to the first end of the arm.

Another aspect of the invention is directed to an apparatus for supporting a user, comprising: a faceplate having a frame that defines an opening to receive a user's face; an arm having opposing first and second ends, the first end attached to the faceplate; and a base. The base comprises: a base body pivotably attached to the second end of the arm, the base body having a base body slot that extends from a distal end towards a proximal end of the base body along a first axis; first and second lock bars disposed on the base body, each lock bar having a length that is parallel to the first axis and a width that is parallel to a second axis that is orthogonal to the first axis, each lock bar defining a plurality of holes that are spaced along the length of a respective lock bar, each hole extending through the respective lock bar parallel to the second axis, the holes defined between opposing inner and outer sides of the respective lock bar; a base slide configured to slidingly engage the slot, the base slide having first and second base slide lock pins; and a button body disposed on the base body and a top side of each lock bar, the button body including a first body slot that slidingly engages a first lock bar pin that extends from the top side of the first lock bar parallel to a third axis that is orthogonal to the first and second axes, and a second body slot that slidingly engages a second lock bar pin that extends from the top side of the second lock bar parallel to the third axis. A distal end of a respective button body slot is closer to a center axis of the base than a proximal end of the respective button body slot, the button body is slidable between a distal position and a proximal position, and the base has (a) a locked state in which the button body is in the proximal position, each lock bar pin is in the distal end of the respective button body slot, and each base slide lock pin is inserted into a respective hole in the respective lock bar to prevent the base slide from sliding in the base body slot and (b) an unlocked state in which the button body is in the distal position and each base slide lock pin and the respective hole in the respective lock bar are separated to allow the base slide to slide in the base body slot.

In one or more embodiments, the apparatus further comprises a spring attached to the button body and the base body, the spring extending parallel to the first axis, the spring having an expanded state when the button body is in the distal position and a contracted state when the button body is in the proximal position. In one or more embodiments, the spring generates a spring force in the expanded state that causes the button body to return to the proximal position when a manual force on the button body is removed.

Yet another aspect of the invention is directed to an apparatus for supporting a user, comprising: a faceplate having a frame that defines an opening to receive a user's face; an arm having opposing first and second ends, the first end attached to the faceplate; and a base. The base comprises: a base body pivotably attached to the second end of the arm, the base body having a base body slot that extends from a distal end towards a proximal end of the base body along a first axis; first and second lock bars disposed on the base body, each lock bar having a length that is parallel to the first axis and a width that is parallel to a second axis that is orthogonal to the first axis, each lock bar defining first and second rows of holes, the first and second rows parallel to the first axis, a base slide configured to slidingly engage the slot, the base slide having first and second base slide lock pins; a button body disposed on the base body and a top side of each lock bar, the button body including a first body slot that slidingly engages a first lock bar pin that extends from the top side of the first lock bar parallel to a third axis that is orthogonal to the first and second axes, and a second body slot that slidingly engages a second lock bar pin that extends from the top side of the second lock bar parallel to the third axis; and a buttress pin guide disposed on the base body, the buttress pin guide having a buttress pin guide slot that extends parallel to the first axis. The apparatus also includes a buttress having opposing first and second ends, the first end of the buttress pivotably attached to the arm, the second end of the buttress pivotably attached to the base, the buttress including first and second buttress lock pins attached at the second end of the buttress and extending parallel to the second axis, the buttress pin guide slot slidingly receiving the buttress lock pins. A distal end of a respective button body slot is closer to a center axis of the base than a proximal end of the respective button body slot, the center axis parallel to the first axis, the button body is slidable between a distal position and a proximal position, and the base has (a) a locked state in which the button body is in the proximal position, each lock bar pin is in the distal end of the respective button body slot, each base slide lock pin is inserted into a respective hole in a respective first row to prevent the base slide from sliding in the base body slot, and each buttress lock pin is inserted into a respective hole in a respective second row to prevent the second end of the buttress from sliding parallel to the first axis in the buttress pin guide, and (b) an unlocked state in which the button body is in the distal position, each base slide lock pin is separated from the respective hole in the respective first row to allow the base slide to slide in the base body slot, and each buttress lock pin is separated from the respective hole in the respective second row to allow the second end of the buttress to slide parallel to the first axis in the buttress pin guide, thereby allowing the second end of the arm to pivot.

Another aspect of the invention is directed to an apparatus for supporting a user, comprising: a faceplate having a frame that defines an opening to receive a user's face; an arm having opposing first and second ends, the first end attached to the faceplate; and a base. The base comprises: a base body pivotably attached to the second end of the arm, the base body having a length that extends from a distal end to a proximal end of the base body along a first axis; first and second lock bars disposed on the base body, each lock bar having a length that is parallel to the first axis and a width that is parallel to a second axis that is orthogonal to the first axis, each lock bar defining a plurality of holes that are spaced along the first axis, a button body disposed on the base body and a top side of each lock bar, the button body including a first body slot that slidingly engages a first lock bar pin that extends from the top side of the first lock bar parallel to a third axis that is orthogonal to the first and second axes, and a second body slot that slidingly engages a second lock bar pin that extends from the top side of the second lock bar parallel to the third axis; and a buttress pin guide disposed on the base body, the buttress pin guide having a buttress pin guide slot that extends parallel to the first axis. The apparatus also comprises a buttress having opposing first and second ends, the first end of the buttress pivotably attached to the arm, the second end of the buttress pivotably attached to the base, the buttress including first and second buttress lock pins attached at the second end of the buttress and extending parallel to the second axis, the buttress pin guide slot slidingly receiving the buttress lock pins. A distal end of a respective button body slot is closer to a center axis of the base than a proximal end of the respective button body slot, the center axis parallel to the first axis, the button body is slidable between a distal position and a proximal position, and the base has (a) a locked state in which the button body is in the proximal position, each lock bar pin is in the distal end of the respective button body slot, and each buttress lock pin is inserted into a respective hole to prevent the second end of the buttress from sliding parallel to the first axis in the buttress pin guide, and (b) an unlocked state in which the button body is in the distal position, and each buttress lock pin is separated from the respective hole to allow the second end of the buttress to slide parallel to the first axis in the buttress pin guide, thereby allowing the second end of the arm to pivot.

BRIEF DESCRIPTION OF THE DRAWINGS

Fora fuller understanding of the nature and advantages of the concepts disclosed herein, reference is made to the detailed description of preferred embodiments and the accompanying drawings.

DETAILED DESCRIPTION

An apparatus for supporting a user in forward-leaning position includes a plurality of mechanical adjustment features that can be independently adjusted and/or customized by the user. The apparatus includes a faceplate, a bridge, an arm, and a base. The faceplate is configured to align with and support the user's head while the user's face is located in an opening defined in the faceplate. The faceplate is pivotably adjustable with respect to the bridge. The arm has a telescoping length that can be adjusted to set the height of the faceplate. The apparatus can also include a chest support plate that can support the user's sternum. The chest support plate is slidably attached to the arm such that the position of the of the chest support plate is adjustable. A buttress extends between the arm and the base to support the arm. The buttress is pivotably and slidably attached to the base and to the arm, thereby allowing the arm to pivot to different angles. In addition, the base includes a base body and a base slide. The base slide is slidably attached to the base body to allow the base to slide towards or away from the user. The apparatus can include one, some, or all of these mechanical adjustments, which can be separately and independently adjusted to customize the configuration of the apparatus.

Figure 4:
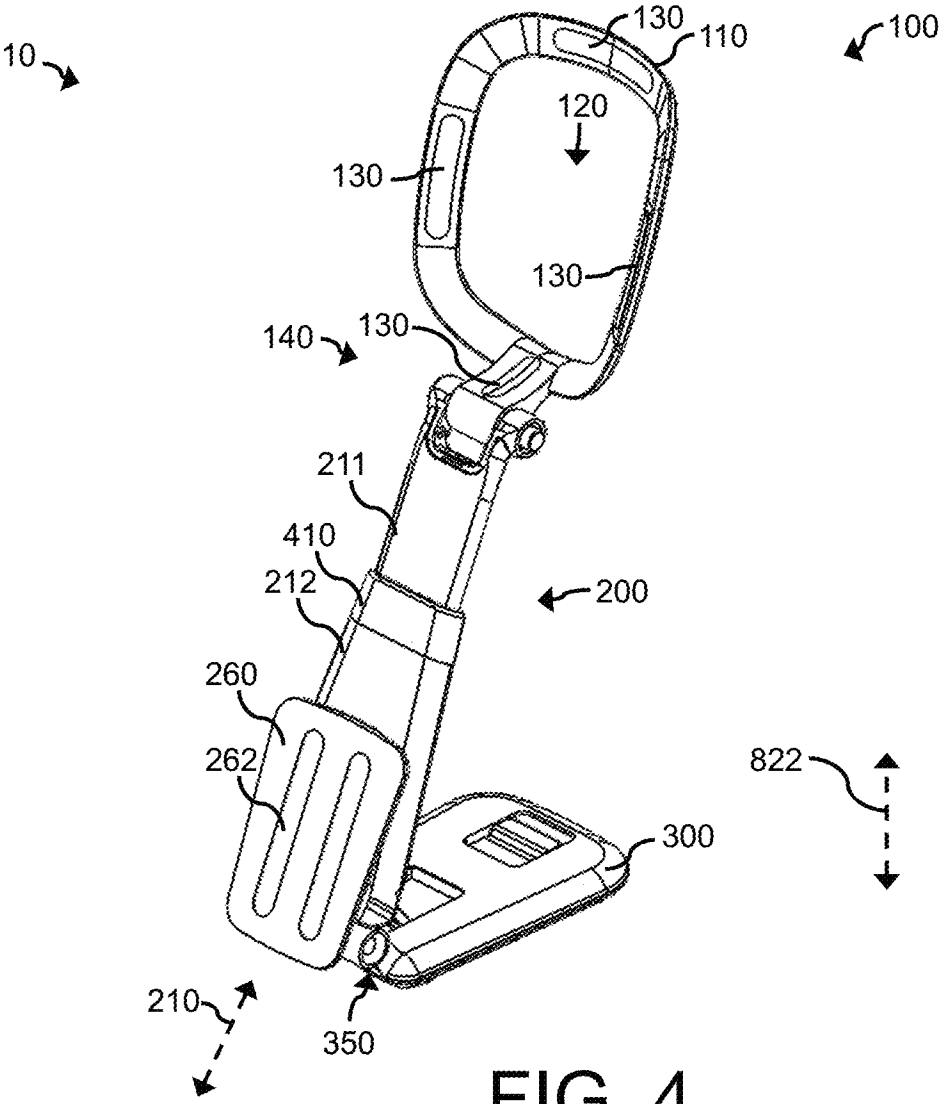
Figure 5:
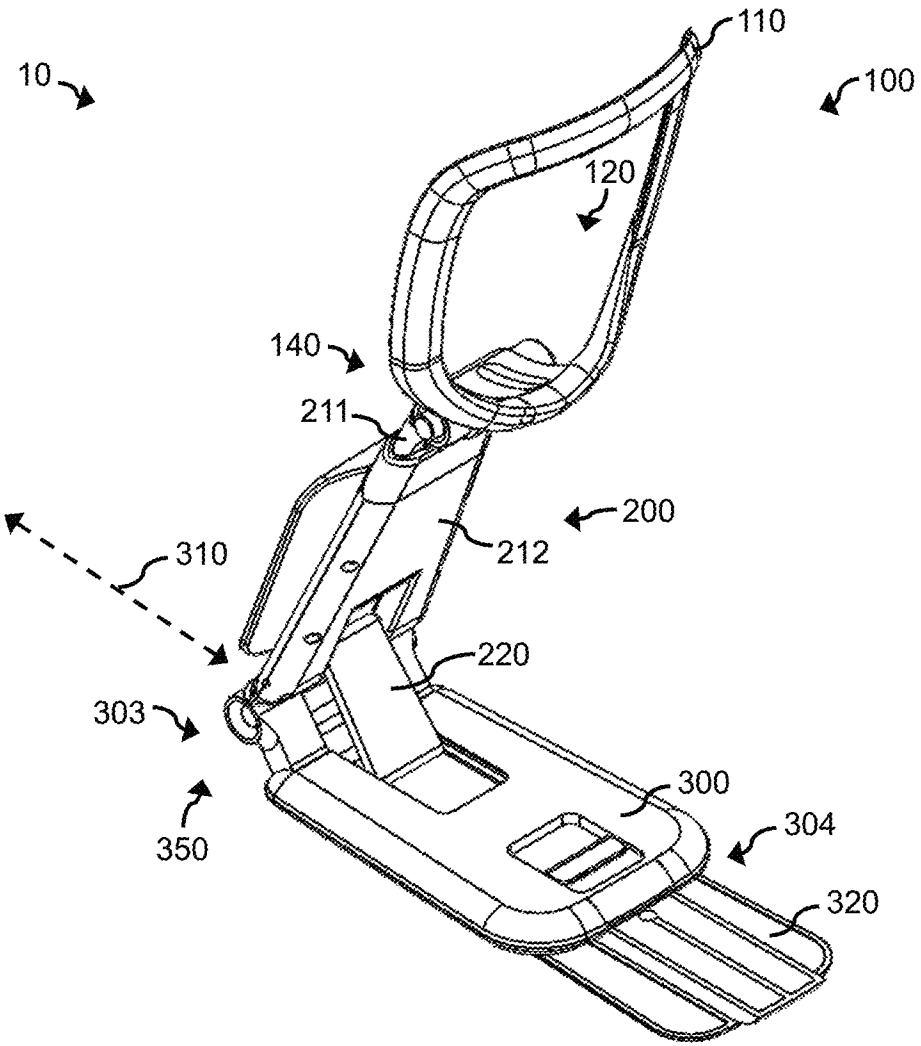
Figure 6:
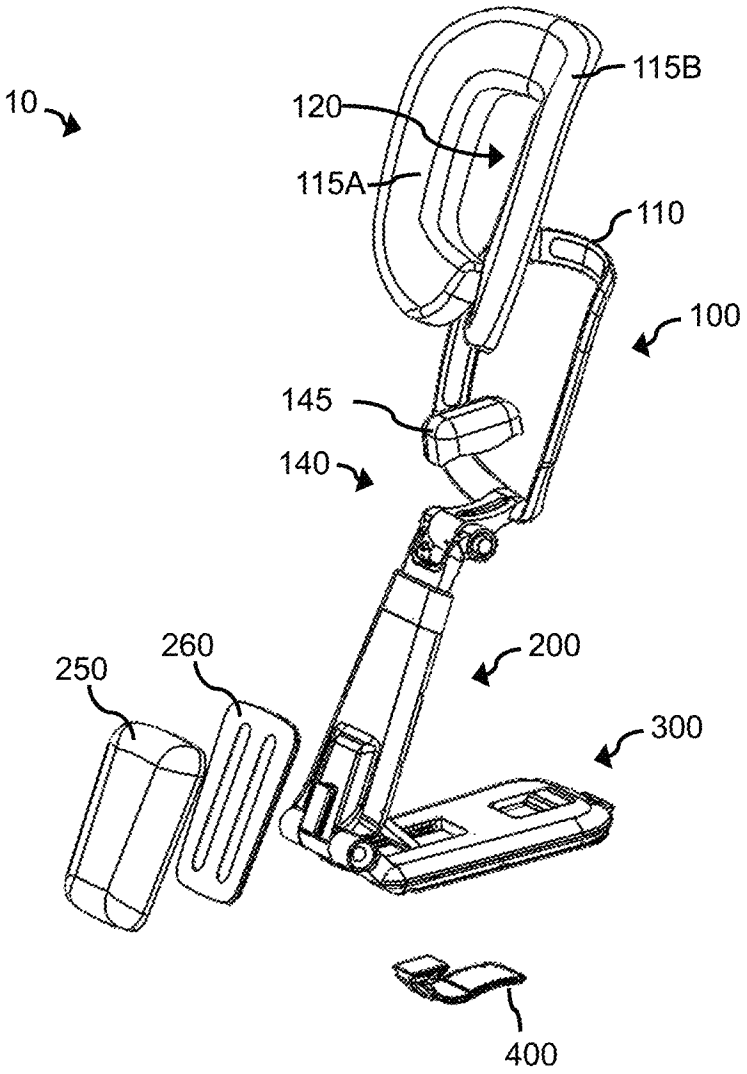
FIG. 6 is an exploded view of the apparatus illustrated in FIGS. 1-5.

FIGS. 1-5 are perspective views of an apparatus 10 for supporting a user in a forward-leaning position, according to an embodiment. FIG. 6 is an exploded view of apparatus 10.

The apparatus 10 includes a faceplate 100, an arm 200, and a base 300. The faceplate 100 is configured to support the front of the user's head. The faceplate 100 includes a frame 110 that defines an opening 120 to receive the user's face. The frame 110 forms a perimeter of a rectangle or square which can optionally have rounded corners (e.g., as illustrated). The opening 120 conforms to the shape of the frame 110 and thus is rectangular or square and can optionally have rounded corners (e.g., as illustrated). The frame 110 and/or opening 120 can have another shape in other embodiments. First and second faceplate cushions 115A, 115B are optionally attached to the frame 110 to improve user comfort. The faceplate cushions 115A, 115B are configured to align with and support the user's forehead and cheeks during use of the apparatus 10 (e.g., when the front of the user's head is located in the opening 120). The faceplate cushions 115A, 115B can be separate cushions or can be combined as a single cushion.

The arm 200 is pivotably attached to the base 300 at a pivot connection 350. The pivot connection 350 includes a shaft 355 that extends along a shaft axis 360, and the arm 200 is pivotable with respect to the shaft axis 360. The shaft axis 360 is orthogonal to the base axis 310. In another embodiment, the pivot connection 350 can include another pivoting mechanism.

Figure 2:
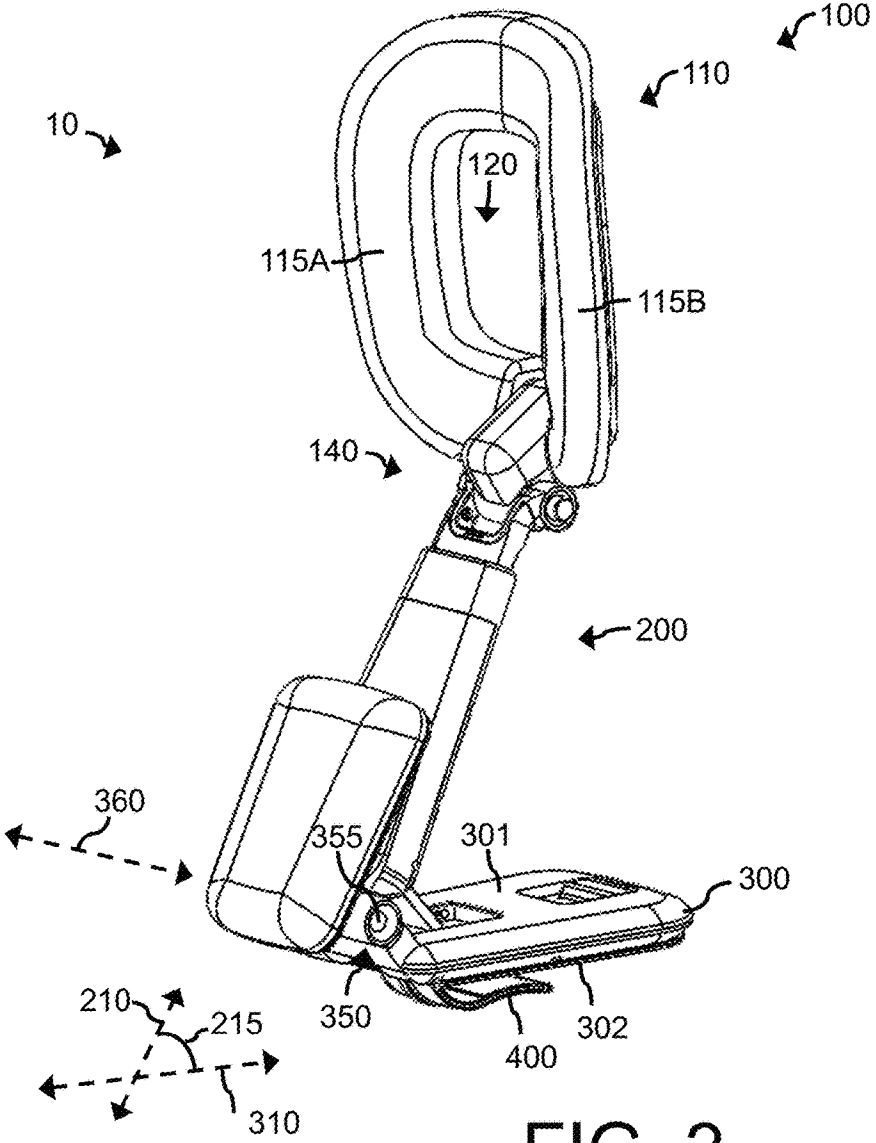
Figure 3:
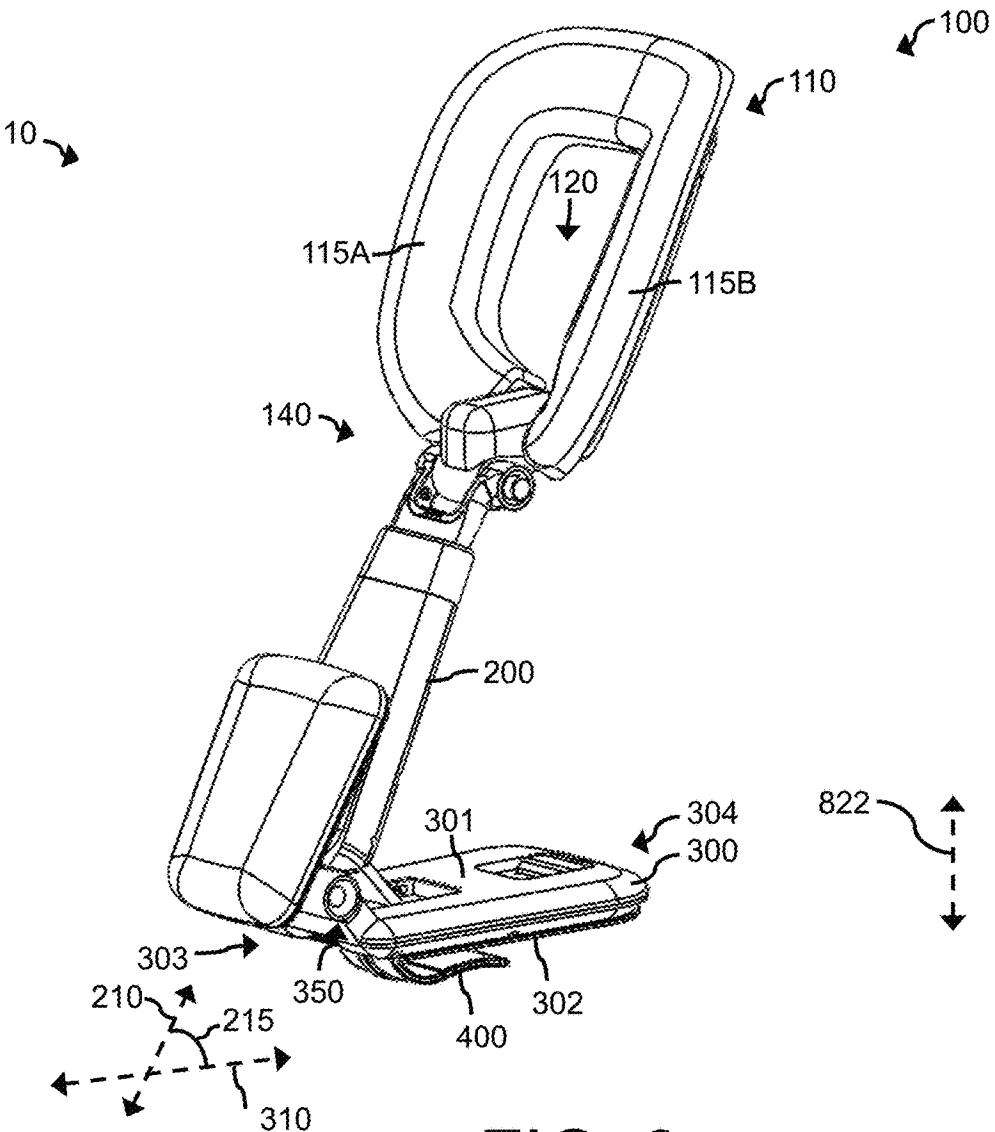

The arm 200 has a length that is measured along an arm axis 210. The angle 215 of the arm 200 can be independently adjusted and/or customized by the user by pivoting the arm towards or away from the base 300, for example as illustrated in FIG. 2. The angle 215 can be measured between the arm axis 210 and a base axis 310, where the base axis 310 is parallel to the top and bottom planar surfaces 301, 302 of the base 300 and/or the base axis 310 extends from a distal end 304 to or towards a proximal end 303 of the base 300. The arm axis 210 extends from a first end 201 to a second end 202 of the arm 200.

A bridge 140 is attached to the first end 201 of the arm 200 and is rotatably attached to the faceplate 100 to allow the faceplate 100 to pivot towards or away from the arm 200 (or towards or away from the base 300 or working surface). For example, in FIG. 3 the faceplate 100 is pivoted further away from the arm 200 compared to FIG. 2. Pivoting the faceplate 100 with respect to the arm 200 allows the pivot position of the faceplate 100 to be independently adjusted and/or customized by the user. An optional bridge cushion 145 can be releasably attached to the bridge 140 to improve user comfort. The bridge cushion 145 is configured to align with and support the user's chin during use of the apparatus 10.

The arm 200 includes upper and lower bodies 211, 212 that are slidably connected to form a telescoping arm. The length of the arm 200 is adjustable along axis 210 to allow the user to independently adjust and/or customize the height of the faceplate 100 with respect to the base 300 (e.g., as measured along axis 822). The arm 200 is in a retracted position in FIG. 1 and in an extended position in FIG. 4. In FIG. 4, the faceplate cushions 115A, 115B and the bridge cushion 145 are removed to illustrate the frame 110 and bridge 140, respectively. FIG. 4 illustrates that the frame 110 and bridge 140 includes mechanical attachment surfaces 130 that can releasably attach the faceplate cushions 115A, 115B and the bridge cushion 145 to the frame 110 and to the bridge 140, respectively. The mechanical attachment surfaces 130 can comprise an adhesive, hook-and-loop fasteners, double-sided tape, or another mechanical attachment surface.

A chest support cushion 250 (FIG. 1) is also removed in FIG. 4 to illustrate a chest support plate 260 that is slidably attached to the arm 200 along the arm axis 210. The user can independently adjust and/or customize the position of the chest support plate 260 on the arm 200 to align the chest support plate 260 and chest support cushion 250 with the user's sternum to support the user's upper body during use of the apparatus 10 (e.g., when the front of the user's head is located in the opening 120). The chest support plate 260 includes one or more mechanical attachment surfaces 262 that can releasably attach the chest support cushion 250 to the chest support plate 260. The mechanical attachment surfaces 262 can be the same as or different than the mechanical attachment surfaces 130.

The base 300 is configured to mechanically support the rest on the apparatus 10 (e.g., the faceplate 100, bridge 140, and arm 200) on a working surface such as on a planar or substantially planar surface of a table, desk, tray, or other surface. The base 300 is configured to slide towards or away from the user along the base axis 310. For example, the base 300 is in a retracted position in FIG. 1. In FIG. 5, the base 300 slides, with respect to a base slide 320, along the base axis 310 toward the proximal end 303 of the base 300 while the base slide 320 remains stationary on the working surface. As such, the base 300, and thus the apparatus 10, can be moved towards or away from the user along the base axis 310 to independently adjust and/or customize the relative proximity of the apparatus 10 with respect to the position of the user. The faceplate cushions 115A, 115B, bridge cushion 145, and chest support cushion 250 are removed from the apparatus 10 in FIG. 5. FIG. 5 also illustrates that a buttress 220 is pivotably attached to the arm 200 and to the base 300. The buttress 220 is configured to support the arm 200 during use of the apparatus 10.

The base 300 can also include an optional hook 400 (FIGS. 1-3) that can be releasably attached to the bottom surface 302 of the base 300. The hook 400 is configured to be mechanically coupled to the edge of the working surface (e.g., a table, desk, or tray). The hook 400 can be flexible to accommodate a range of working surface thicknesses. When the hook 400 mechanically couples or engages the edge of the working surface, the hook 400 can prevent the base 300 from sliding away from the user (e.g., towards the distal end 304 of the base 300) during use of the apparatus 10 (e.g., when the front of the user's head is located in the opening 120). Additionally or alternatively, a gripping or high-friction material can be disposed on the bottom surface 302 of the base 300 to prevent the base 300 from sliding away from the user during user of the apparatus 10. The gripping or high-friction material can comprise rubber, plastic, or another gripping or high-friction material.

In some embodiments, a kit or system can be provided that includes the apparatus 10 and a plurality of hooks 400 having different sizes to accommodate working surfaces having different thicknesses. Additionally or alternatively, the kit or system can include the apparatus 10 and a plurality of cushions 115A, a plurality of cushions 115B, and/or a plurality of cushions 145, each cushion having a different firmness or softness.

Thus, the apparatus 10 includes a plurality of mechanical adjustments that can be independently adjusted and/or customized by the user. The mechanical adjustments include (1) the pivot position of the faceplate 100 (e.g., by pivoting the faceplate 100 with towards or away from the arm 200 or base 300), (2) the height of the faceplate 100 (e.g., by adjusting the length of the arm 200), (3) the angle 210 of the arm 200 (e.g., by pivoting the arm 200 with respect to the base 300), (4) the height of the chest support plate 260 and chest support cushion 250 (e.g., by sliding the chest support plate 260 with respect to the arm 200), and (5) the proximity of the apparatus 10 (e.g., by sliding the base 300 towards or away from the user). In a preferred embodiment, the apparatus 10 includes all of these mechanical adjustments. In other embodiments, the apparatus 10 includes only one or only some of these mechanical adjustments.

Figure 7:
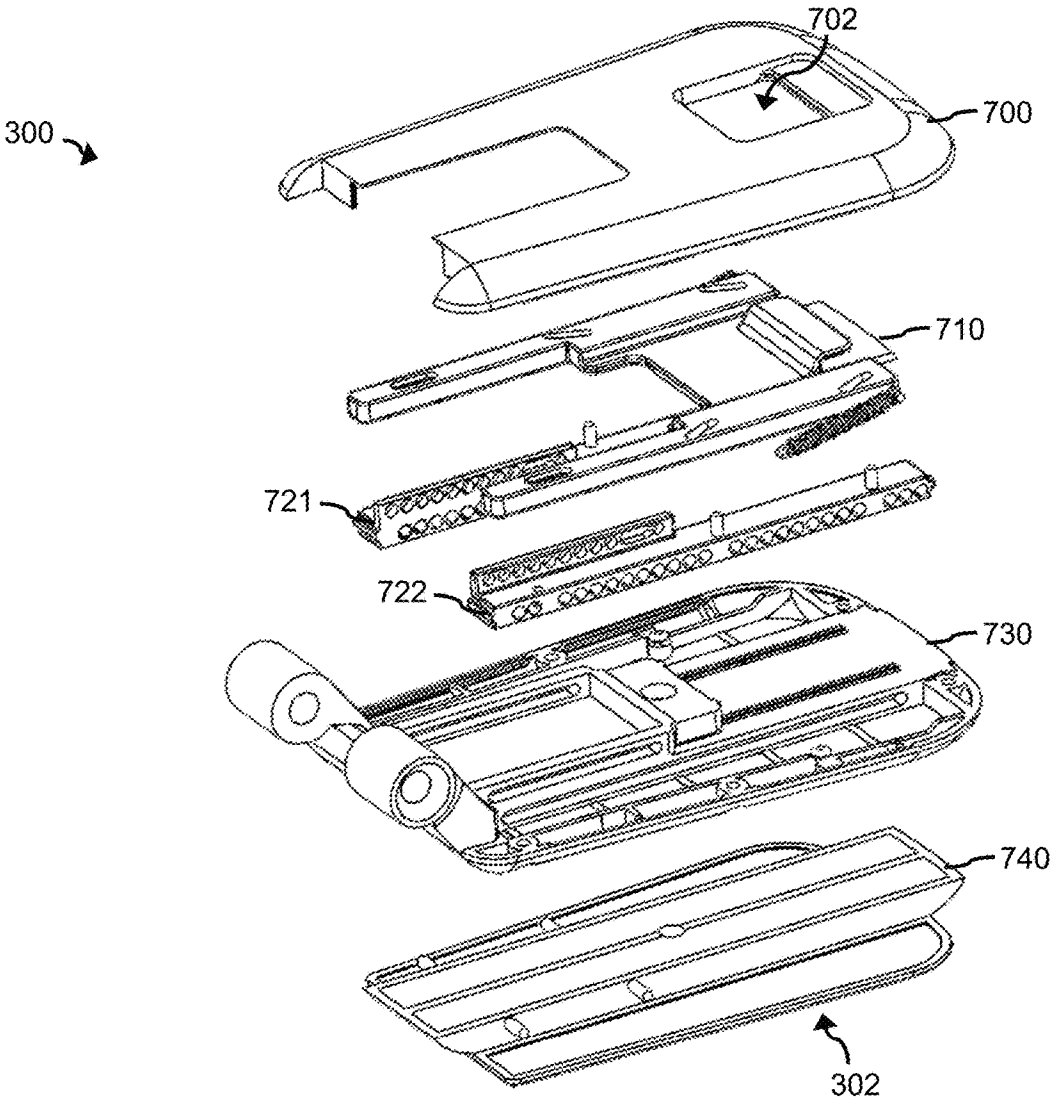
FIG. 7 is an exploded view of the base of the apparatus illustrated in FIGS. 1-5.

FIG. 7 is an exploded view of the base 300 according to an embodiment. The base 300 includes a cover housing 700, a button body 710, first and second lock bars 721, 722, a base body 730, and a base slide 740. The button body 710 and the lock bars 721, 722 are disposed between the base body 730 and the cover housing 700. The base slide 740 is slidably attached to the bottom of the base body 730. The base slide 740 can be the same as base slide 320. In some embodiments, the base 300 only has one lock bar 721 or 722.

Figure 8:
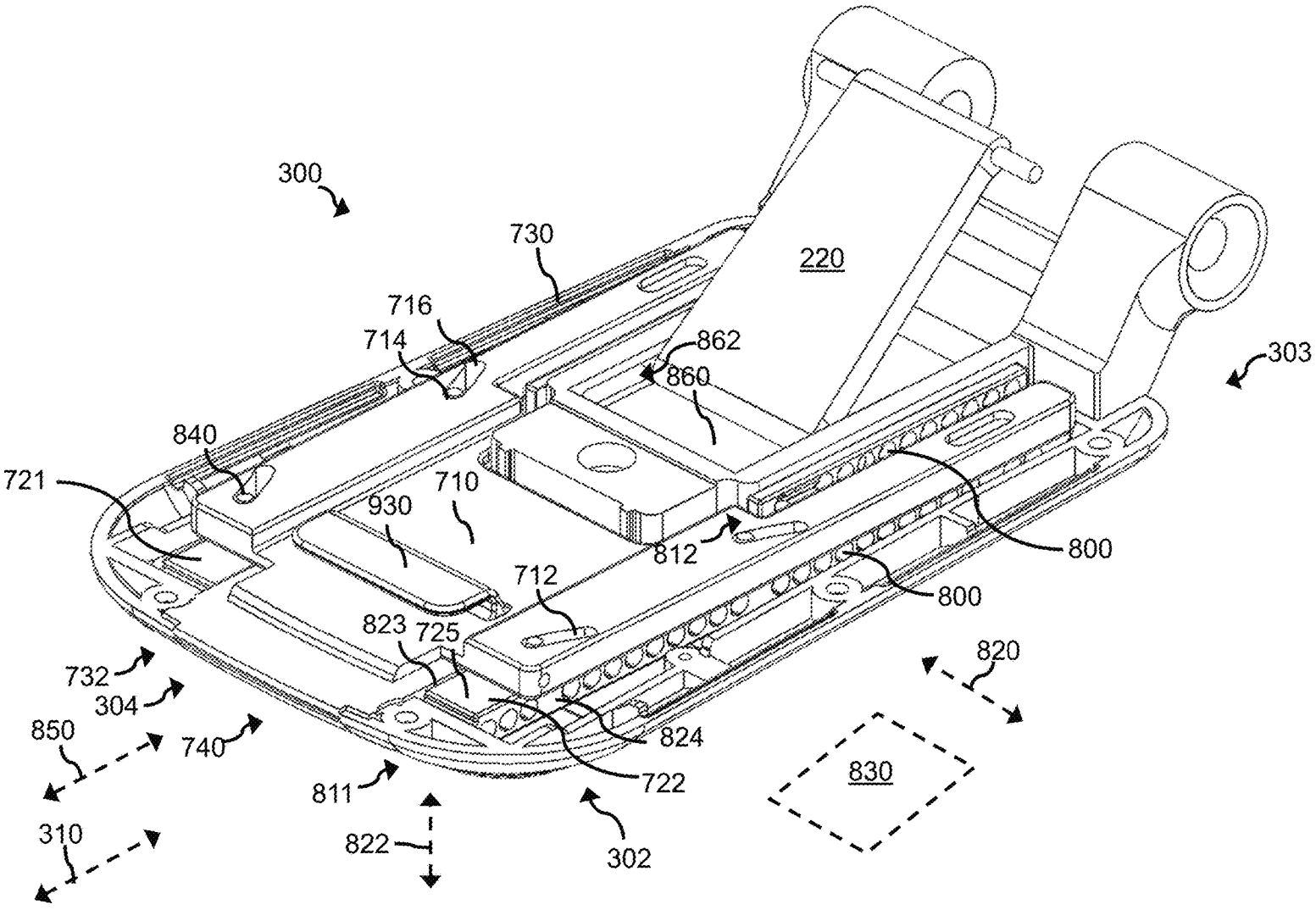
FIG. 8 is a perspective view of the base with the cover housing removed, where the base slide is in a stowed position and the base is in a locked state according to an embodiment.
Figure 9:
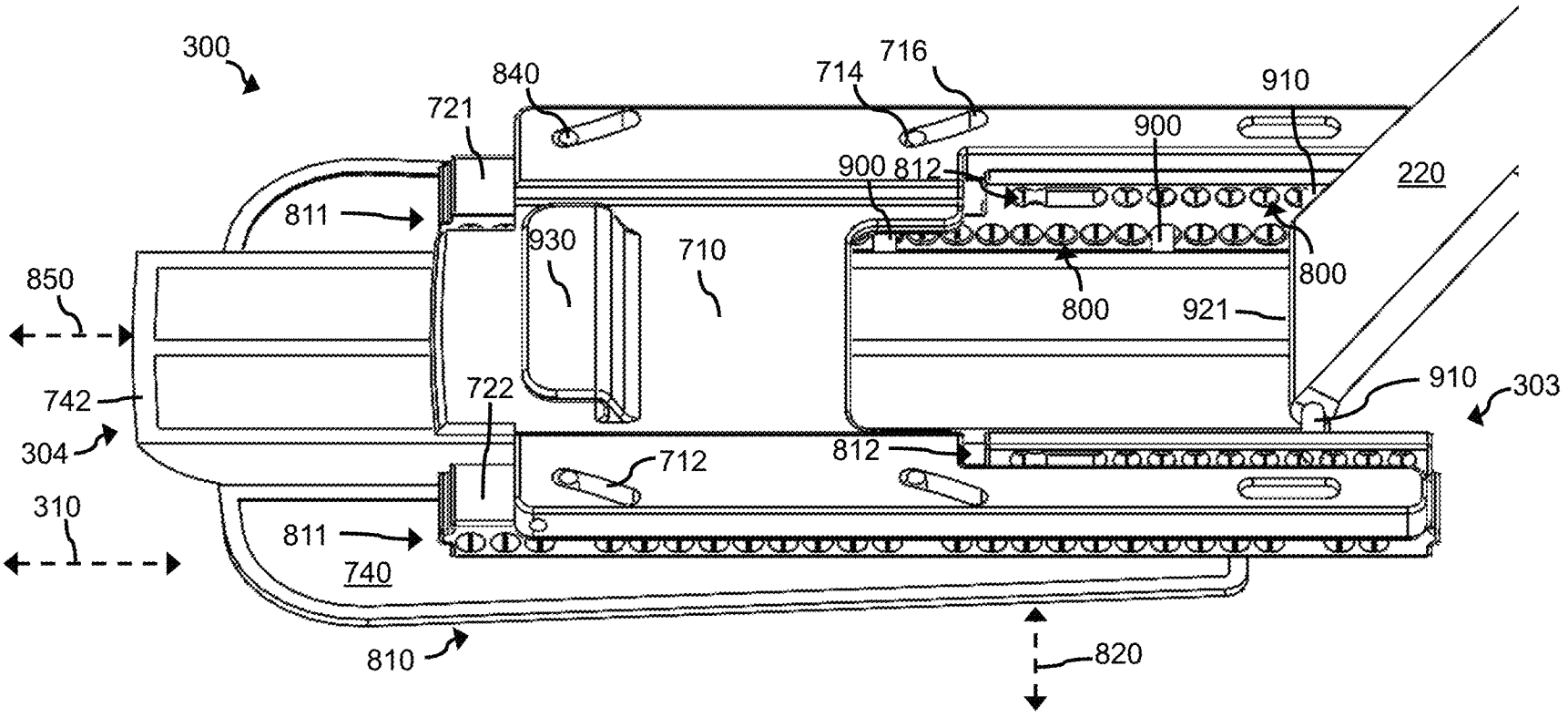
FIG. 9 is a perspective view of the base with the cover housing removed, where the base slide is in a deployed position and the base is in a locked state according to an embodiment.

FIG. 8 is a perspective view of the base 300 with the cover housing 700 removed, according to an embodiment. The base body 730 defines a slot 732 (e.g., a base body slot) that extends from the distal end 304 to or towards the proximal end 303 of the base 300. The slot 732 is configured to slidingly engage opposing sides of a raised body 742 on the base slide 740, as illustrated in FIG. 9. In FIG. 8, the base slide 740 is in a stowed position where the base slide 740 is pushed into the slot 732 such that the base slide 740 is disposed in the base body 730. In FIG. 9, the base slide 740 is in a deployed position in which the base slide 740 extends out the slot 732 such that at least a portion of the base slide 740 is disposed away from the base body 730.

The first and second lock bars 721, 722 have elongated lengths that can be measured with respect to the base axis 310 (e.g., a first axis). Each lock bar 721, 722 includes a plurality of holes 800 that are spaced apart along the length of the respective lock bar 721, 722. The holes 800 are preferably evenly-spaced along the length of the respective lock bar 721, 722. Each lock bar 721, 722 includes first and second rows 811, 812 of holes 800. The first row 811 of holes 800 is located closer to the bottom surface 302 of the base 300 than the second row 812 of holes 800. The holes 800 are preferably identically-sized (e.g., have identical diameters). In other embodiments, the holes 800 can be irregularly spaced and/or a combination or regularly and irregularly spaced along the length of the respective lock bar 721, 722. Each hole 800 extends through the respective lock bar 721, 722, from an inner side 823 to an outer side 824 of each lock bar 721, 722 and parallel to a second axis 820 that is orthogonal to the base axis 310. The first and second axes 310, 820 define a plane 830 that is parallel to the top and bottom surfaces 301, 302 of the base 300. The plane 830 is also parallel to a top side 725 of each lock bar 721, 722. Each row 811, 812 of holes 800 is parallel to the first axis 310.

In addition, the lock bars 721, 722 have one or more lock bar pins 840 that extend vertically from the top side 725 of each lock bar 721, 722. Each lock bar pin 840 has a height that can be measured with respect to a third axis 822 that is orthogonal to the first and second axes 310, 820. Each lock bar pin 840 is configured to engage a corresponding slot 712 (e.g., a button body slot) defined in the button body 710. The slots 712 are oriented in a direction between the first and second axes 310, 820 that is parallel to plane 830. A distal end 714 of each slot 712 is located closer to a center axis 850 of the base 300 than a proximal end 716 of the respective slot 712. The slots 712 can be linear or curved. The button body 710 can include only one slot 712 or multiple slots 712 associated with each lock bar 721, 722. The center axis 850 can be a center axis of symmetry of the base 300.

Figure 10:
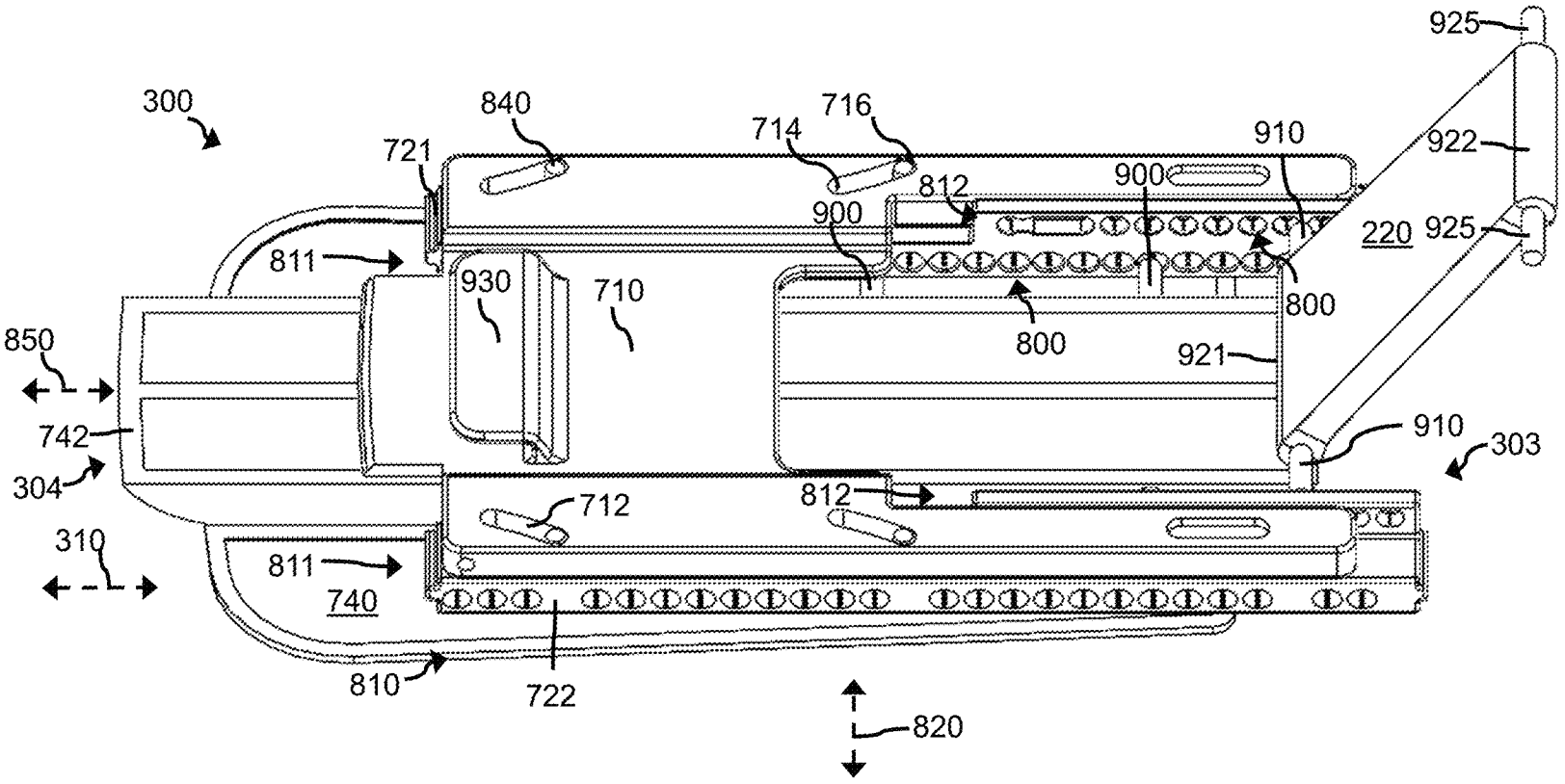
FIG. 10 is a perspective view of the base with the cover housing removed, where the base slide is in a deployed position and the base is in an unlocked state according to an embodiment.

One or more base-slide lock pins 900 on the base slide 740 are configured to releasably and/or slidably engage a respective one or more holes 800 in the first row 811 of each lock bar 721, 722, as illustrated in FIG. 9. The base-slide lock pins 900 are attached to opposing sides of the raised body 742 of the base slide 740. In addition, a buttress lock pin 910 at a first end 921 of buttress 220 is configured to releasably and/or slidably engage one of the holes 800 in the second row 812 of each lock bar 721, 722. The lock pins 900, 910 extend parallel to the second axis 820 so that they can slide into one the holes 800 in the respective row 811, 812. A second end 922 of the buttress 220 includes pivot pins 925, as illustrated in FIG. 10, that are configured to pivot with respect to the arm 200. The pivot pins 925 extend parallel to the second axis 820.

The relative position of the base slide 740 with respect to the first axis 310 and with respect to the base body 730 is set by adjusting which holes 800 in the first row 811 the base-slide lock pins 900 engage (e.g., slide into). The relative position of the base slide 740 with respect to the base body 730 along the first axis 310 determines the relative proximity of the apparatus 10 with respect to the user. In addition, the relative position of the buttress 220 with respect to the base body 730 along the first axis 310 is set by adjusting which holes 800 in the second row 812 the buttress lock pins 910 engage. The relative position of the buttress 220 with respect to the first axis 310 determines the arm angle 215. The buttress lock pins 910 are slidingly disposed in respective slots 862 (e.g., buttress pin guide slots) in a buttress pin guide 860 (FIG. 8) which can be part of or attached to the base body 730. The buttress pin guide 860 is not illustrated in FIG. 9 to not obscure the buttress lock pins 910. In some embodiments, the buttress 220 only includes one buttress lock pin 910 and the buttress pin guide 860 only includes one corresponding slot 862.

In operation, the base 300 has a locked state and an unlocked state. In the locked state, the lock bar pins 840 are disposed at the distal end 714 of the slots 712, as illustrated in FIGS. 8 and 9. When the lock bar pins 840 are disposed at the distal end 714 of the slots 712, the lock bars 721, 722 are moved inward towards the center axis 850 of the base 300, which causes the first and second rows 811, 812 of holes 800 to move towards and engage (e.g., slide over) the base-slide lock pins 900 and the buttress lock pins 910, respectively. When the lock pins 900 are inserted into the holes 800 in the first and second rows 811, 812, the lock pins 900, 910 cannot move parallel to the first axis 310, thus locking and setting the position of the base slide 740 (e.g., by locking the base slide 740) and the arm angle 215 (e.g., by locking the first end 921 of the buttress 220), respectively.

In the unlocked state, the lock bar pins 840 slide to the proximal end 716 of the slots 712, as illustrated in FIG. 10. When the lock bar pins 840 are located at the proximal end 716 of the slots 712, the lock bars 721, 722 are moved outward away from the center axis 850 of the base 300, which causes the first and second rows 811, 812 of holes 800 to move away from and disengage (e.g., slide out) from the base-slide lock pins 900 and from the buttress lock pins 910, respectively. Since the holes 800 and the lock pins 900, 910, are not engaged, the lock pins 900, 910 can move parallel to the first axis 310. Thus, the base slide 740 and the first end 921 of the buttress 220 can slide freely with respect to the first axis 310.

For example, the first end 921 of the buttress 220 can slide towards or away from the proximal or distal ends 303, 304 of the base 300. When the first end 921 of the buttress 220 slides towards the distal end 304 of the base 300, the arm angle 215 decreases (e.g., down to about 15° or lower at which point the arm 200 can be disposed against and/or parallel to the base 300). When the first end 921 of the buttress 220 slides away from the distal end 304 of the base 300, the arm angle 215 increases (e.g., up to about 90°). The base slide 740 and the buttress 220 can slide independently (e.g., with respect to the lock bars 721, 722 and holes 800), thereby allowing the base slide 740 and the buttress 220 to be individually adjusted for a customized fit for the user.

The lock bar pins 840 can move with respect to the slots 712 when the user manually slides or pushes a raised button 930, attached to the button body 710, towards the distal end 304 of the base 300. The button 930 is disposed in a button hole 702 (FIG. 7) defined in the cover housing 700. In addition, the button 930 can at least partially extend vertically (e.g., parallel to the third axis 820) from the button body 710. Sliding the button 930 distally causes the button body 710 to move in the distal direction along axis 310, which causes the proximal end 716 of the slots 712 to engage the lock bar pins 840. Since the proximal end 716 is located further away from the center axis 850 than the distal end 714, the lock bar pins 840 are moved outward and away from the center axis 850, which causes the respective lock bars 721, 722 to move outward and away from the center axis 850. When the lock bars 721, 722 are moved outward and away from the center axis 850, the holes 800 in the first and second rows 811, 812 become separated and disengaged from the base-slide lock pins 900 and the buttress lock pins 910, respectively, thereby allowing the positions of the base slide 740 and the buttress 220 to be individually adjusted for a customized fit for the user.

Figure 11:
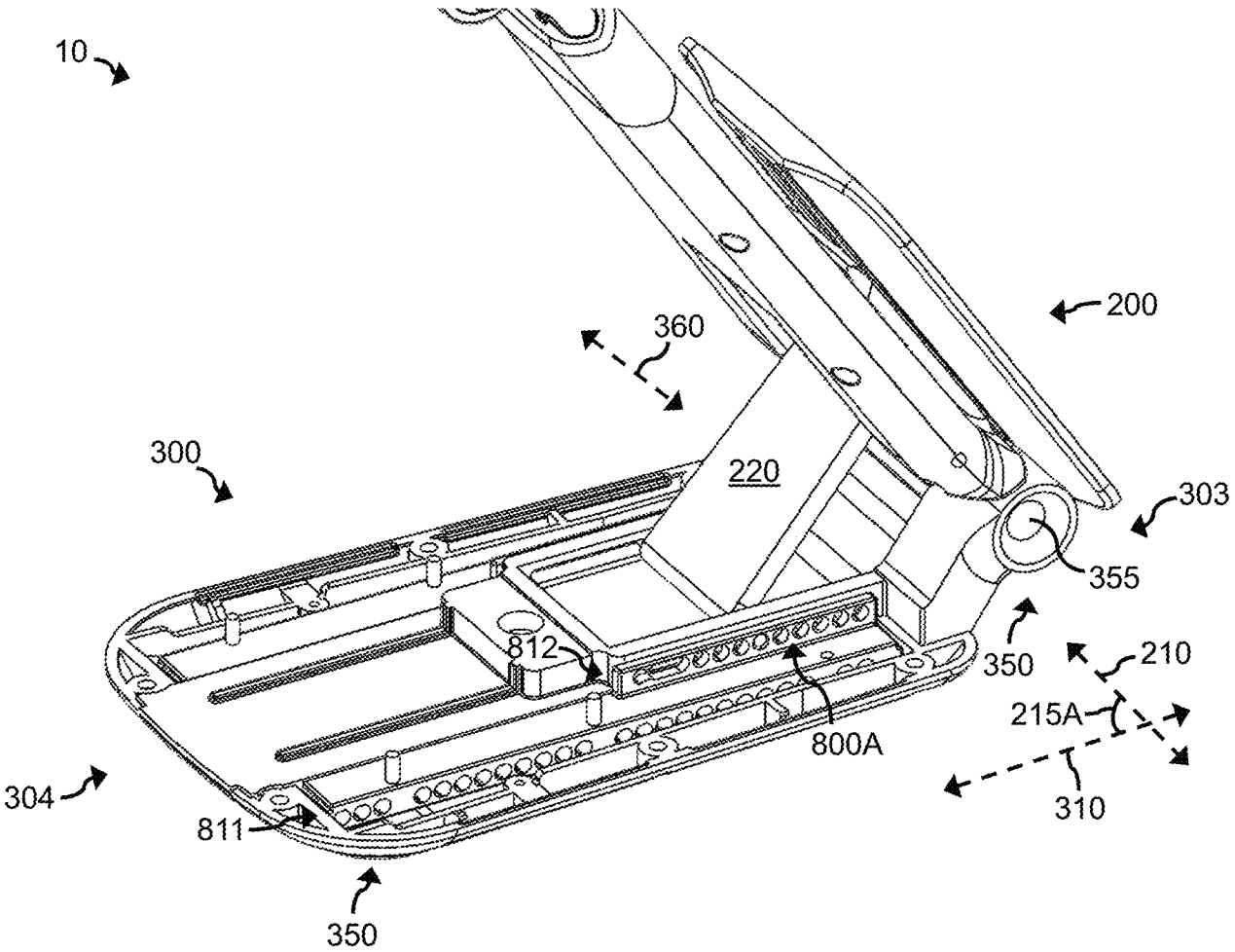
FIG. 11 is a perspective view of the base with the cover housing removed, where the base is in the unlocked state and the buttress lock pins are in a first position.
Figure 12:
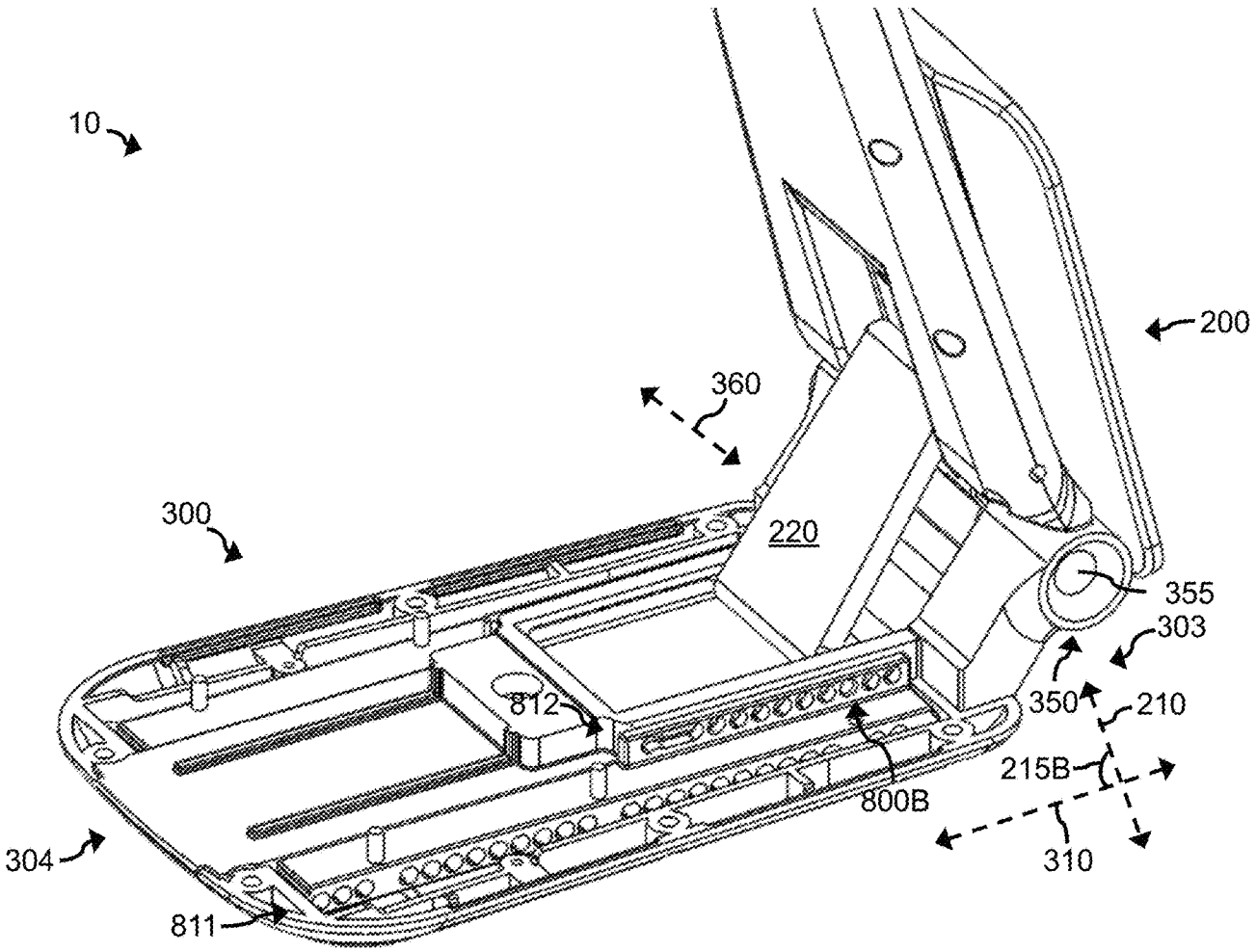
FIG. 12 is a perspective view of the base with the cover housing removed, where the base is in the unlocked state and the buttress lock pins are in a second position.

For example, in the unlocked state, the buttress lock pins 910 can be moved from a first position in which the buttress lock pins 910 are aligned with a first hole 800A in the second row 812 of holes 800, as illustrated in FIG. 11, to a second position in which the buttress lock pins 910 are aligned with a second hole 800B in the in the second row 812 of holes 800, as illustrated in FIG. 12. When the buttress lock pins 910 are aligned with the first hole 800A, the arm 200 has a first angle 215A. When the buttress lock pins 910 are aligned with the second hole 800B, the arm 200 has a second angle 215B. The second angle 215B is greater than the first angle 215A. In addition, the first hole 800A is located closer to the distal end 304 of the base 300 than the second hole 800B, and the second hole 800B is located further from the distal end 304 of the base 300 than the first hole 800A. Conversely, the buttress lock pins 910 can be moved from the second position in which the buttress lock pins 910 are aligned with the second hole 800B to the first position in which the buttress lock pins 910 are aligned with the first hole 800A.

Figure 13:
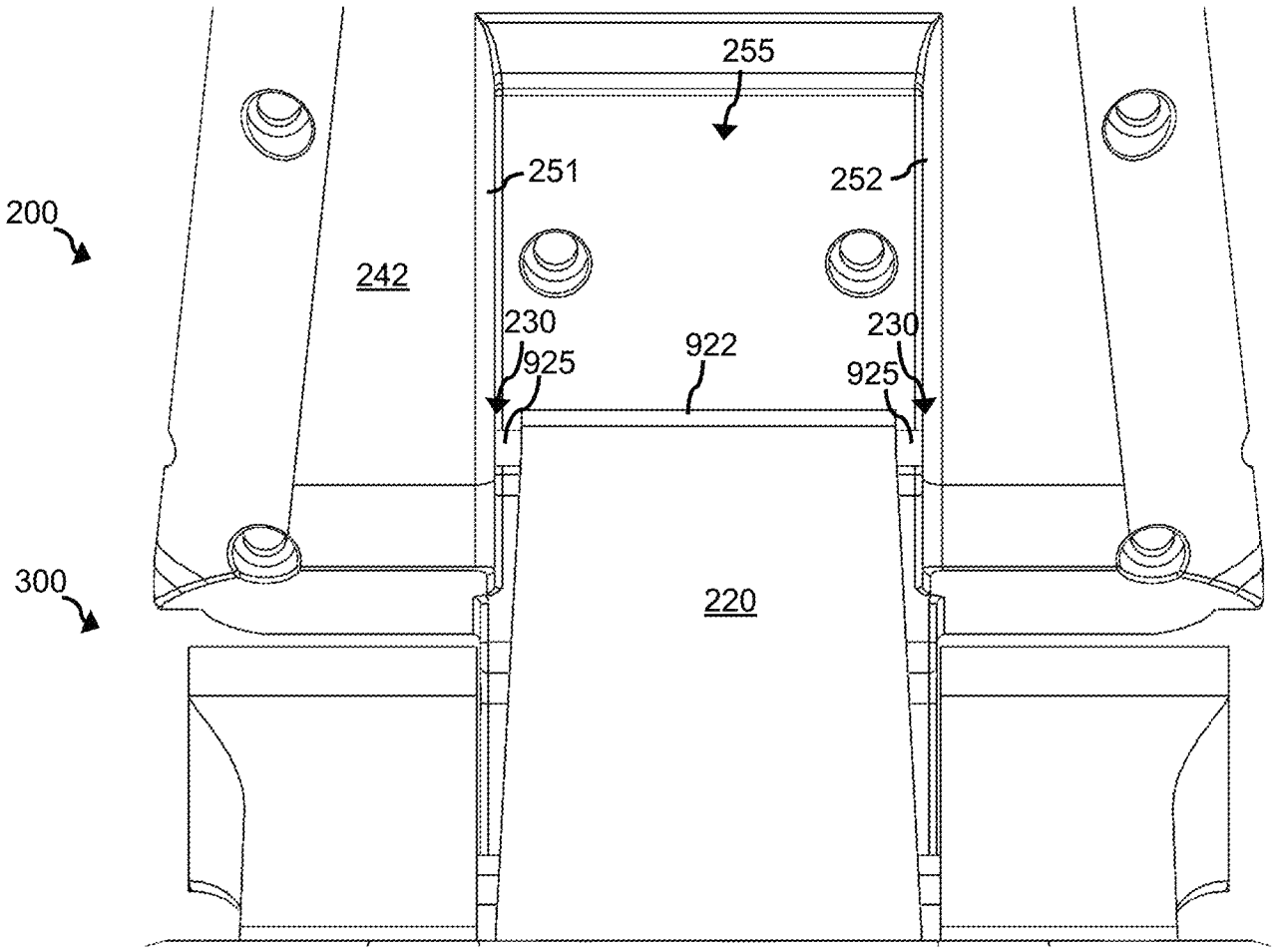
FIG. 13 is a rear view of the arm, buttress, and base according to an embodiment.
Figure 29:
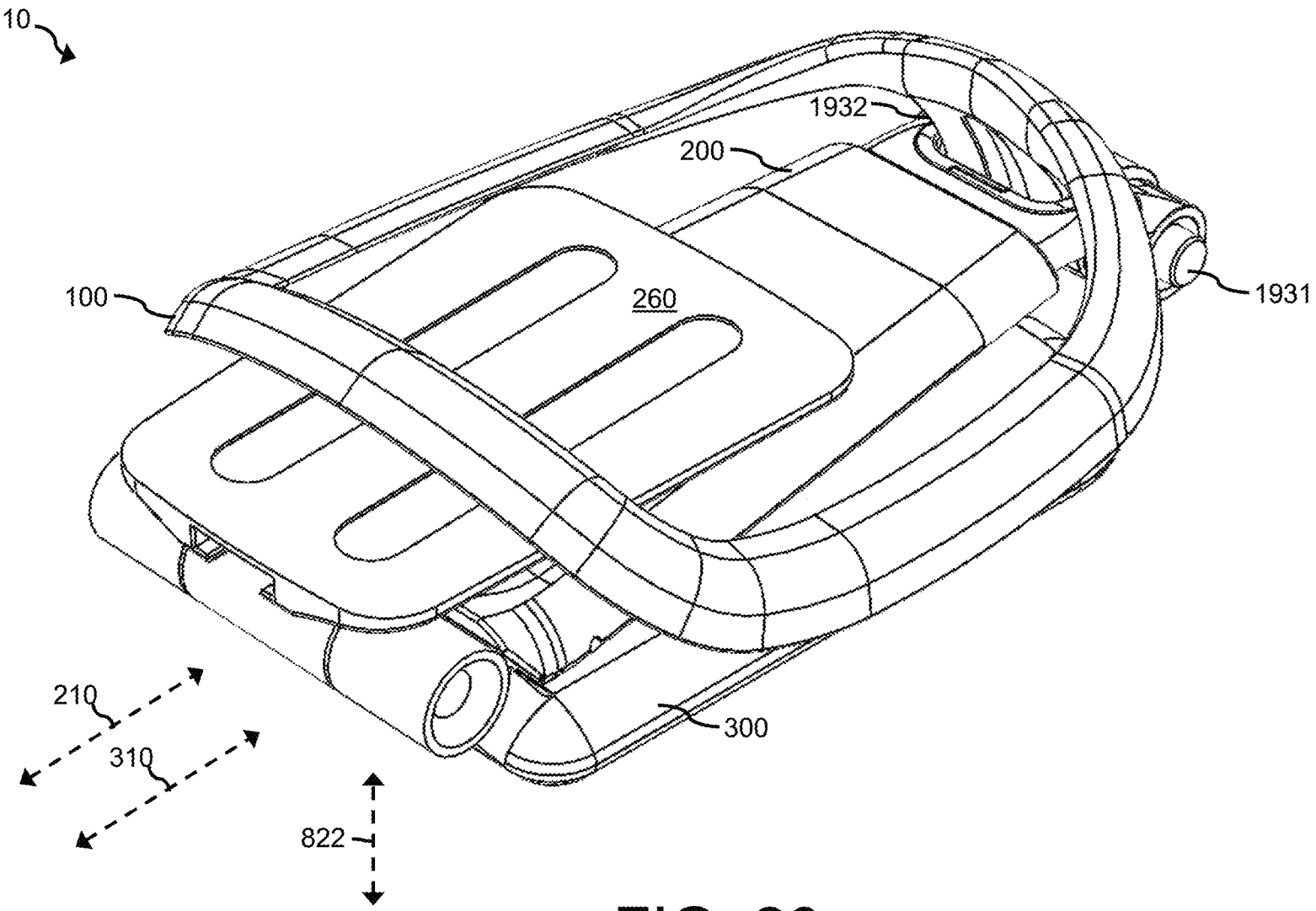
FIG. 29 is a perspective view of the apparatus in a stowed state according to an embodiment.

When the buttress lock pins 910 are moved, such as from the first position to the second position (or vice versa), the first end 921 of the buttress 220 is moved proximally or distally (e.g., parallel to the first axis 310) along with the buttress lock pins 910. Moving the first end 921 of the buttress 220 proximally or distally causes the second end 922 of the buttress 220 to pivot. For example, pivot pins 925 are attached to the second end 922 of the buttress 220, as illustrated in FIG. 13. The pivot pins 925 are disposed in a respective hole or slot 230 defined in the back or distal side 242 of the arm 200. The pivot pins 925 can rotate within the holes or slots 230 when the first end 921 of the buttress 220 is moved proximally or distally. The holes of slots 230 can be defined in opposing walls 251, 252 that partially define a recess 255 in the back or distal side 242 of the arm 200. When the arm 200 is in the stowed configuration (as illustrated in FIG. 29), a portion of the buttress 220 near the second end 922 is disposed in the recess 255 to reduce the height of the apparatus in the apparatus stowed state.

Figure 14:
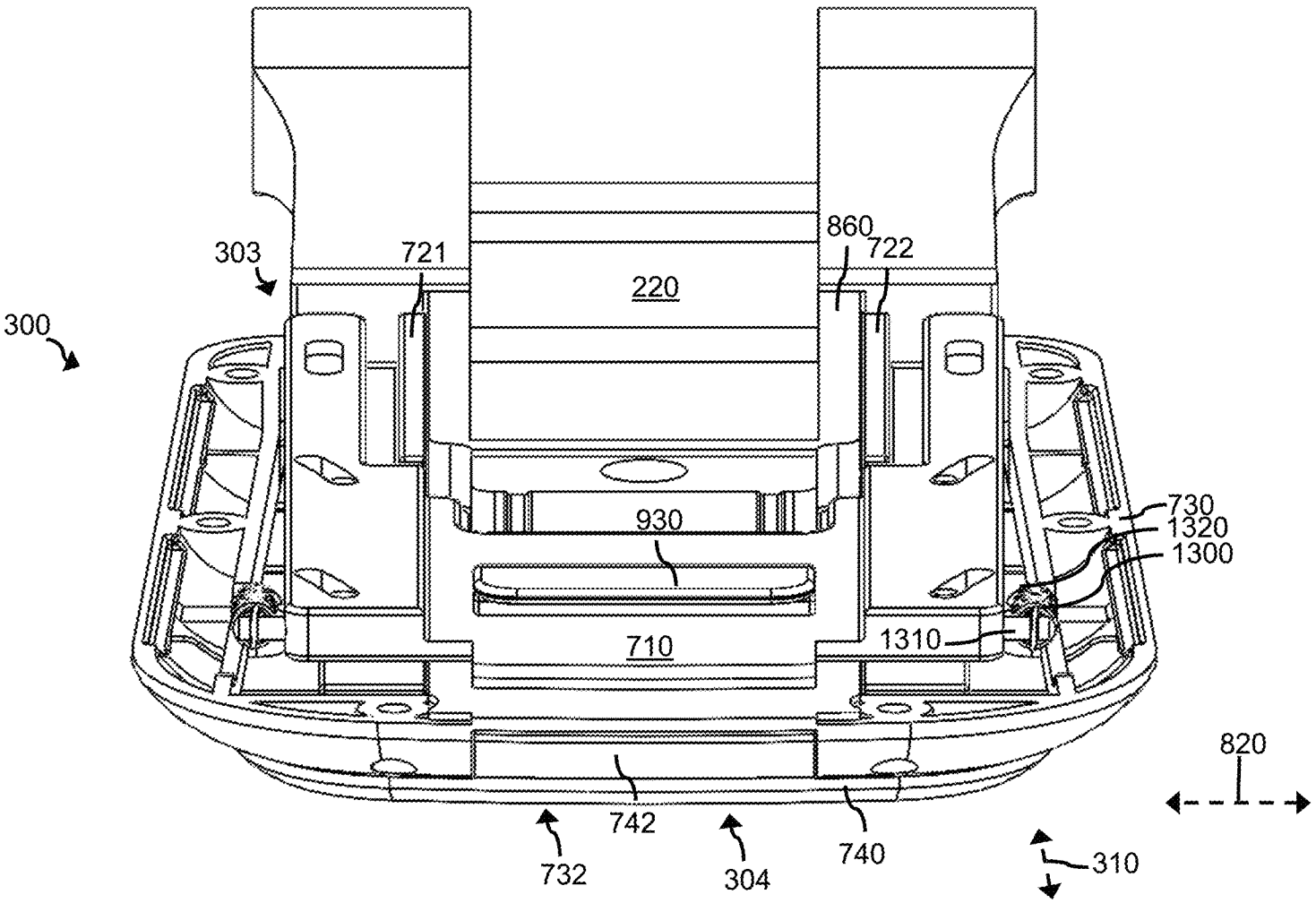
FIG. 14 is a rear perspective view of the apparatus with the base in a locked state.
Figure 15:
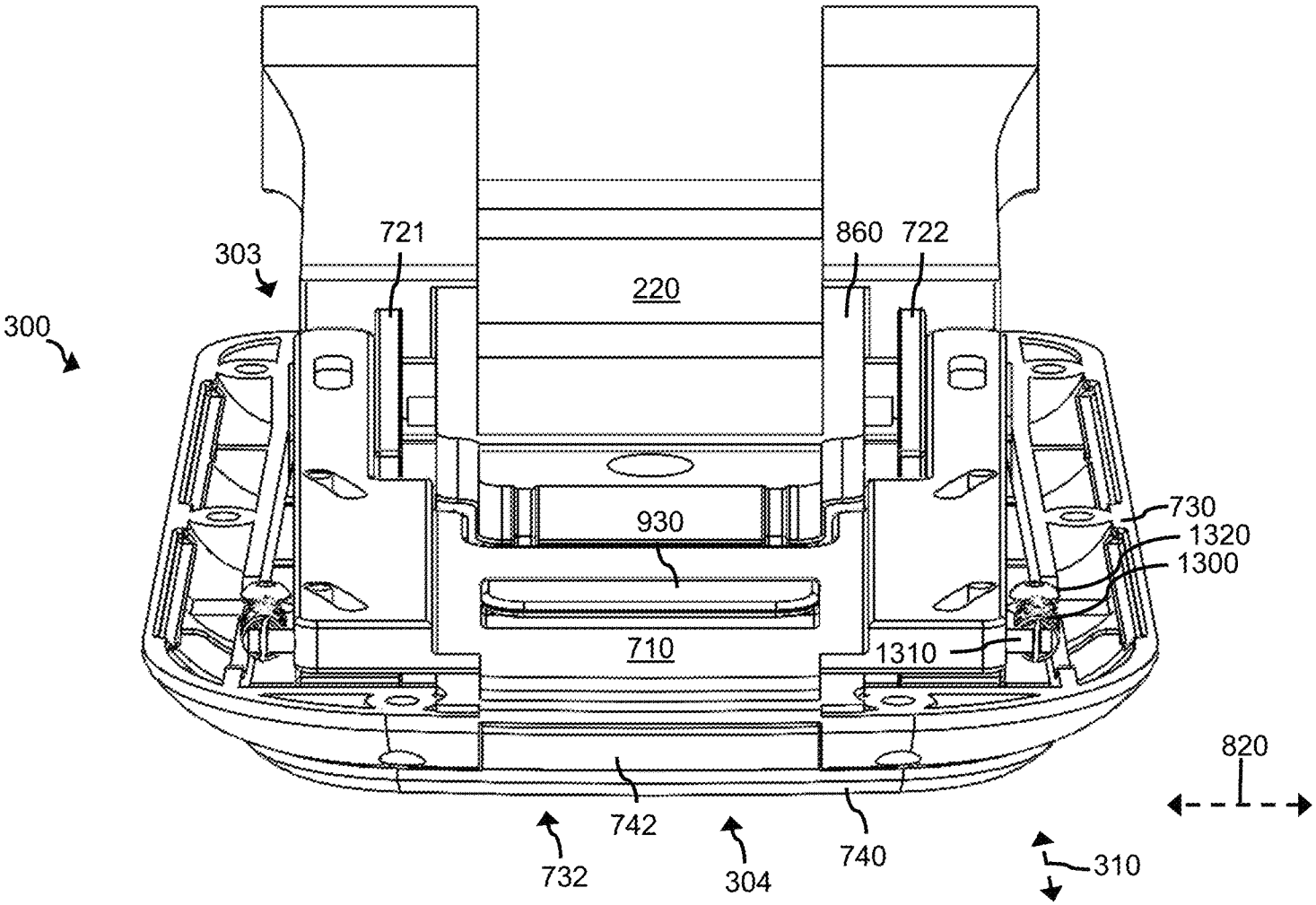
FIG. 15 is a rear perspective view of the apparatus with the base in an unlocked state.

The button body 710 can be mechanically biased towards the proximal end 303 of the base 300 to automatically return the base 300 from the unlocked state (e.g., when the button 930 is in a distal position towards the distal end 304 of the base 300) to the locked state (e.g., when the button 930 is in a proximal position towards the proximal end 303 of the base 300). For example, one or more springs 1300 can be mechanically coupled and/or attached to the button body 710 and the base body 730, as illustrated in FIGS. 14 and 15. The springs 1300 can be attached to a horizontal projection 1310 on opposing sides of the button body 710. The horizontal projections 1310 can extend outwardly from the button body 710 and parallel to the second axis 820. The springs 1300 can extend parallel to the first axis 310 from the horizontal projection 1310 to an attachment point 1320 on the base body 730. When the base 300 is in the locked state, the springs 1300 are in a contracted state, as illustrated in FIG. 14. When the base 300 is in the unlocked state, the springs 1300 are in an expanded state, as illustrated in FIG. 15. When the springs 1300 are in the expanded state, the springs 1300 can have increased tension and apply increased force on the button body 710 compared to when the springs 1300 are in the contracted state. The increased force and tension cause the button body 710 to slide towards the proximal end 303 of the base 300 to return and remain the base 300 to the locked state (e.g., when a force, such as a user's finger, is removed from the button 930).

Figure 16:
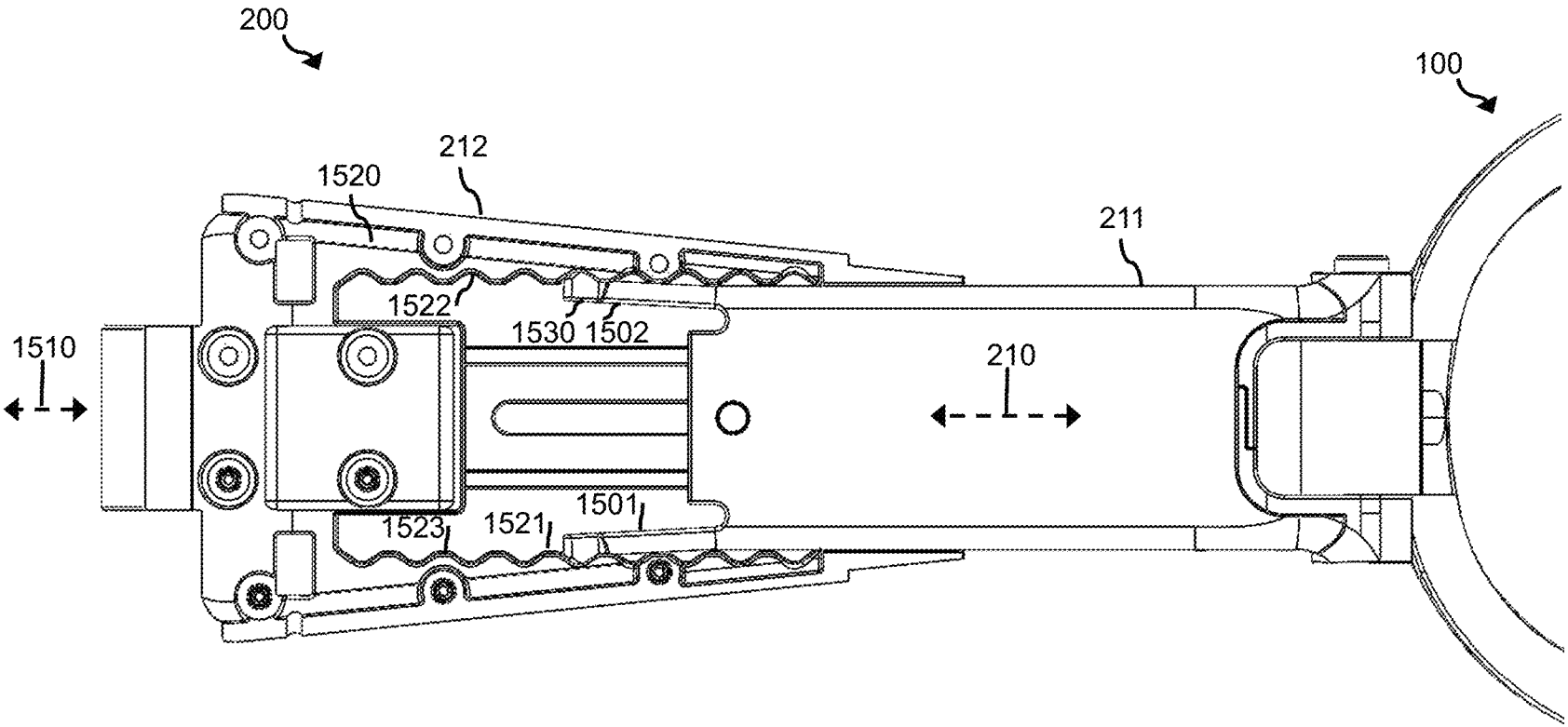
FIG. 16 is a top view of the arm with the housing removed to illustrate the telescoping upper and lower bodies in an expanded state.

FIG. 16 is a top view of the arm 200 with the housing removed to illustrate the telescoping upper and lower bodies 211, 212 in an expanded state. The upper body 211 can slide into and out of the lower body 212. The upper body 211 includes first and second fingers 1501, 1502 that extend towards the lower body 212 and parallel to the arm axis 210. The first and second fingers 1501, 1502 are on opposing sides of an axis of symmetry 1510 of the arm 200. The lower body 212 includes opposing internal walls 1520 that define respective scalloped surfaces 1521. An outwardly-projecting end 1530 of each finger 1501, 1502 has a complementary shape to that of the indentations 1522 of the scalloped surface 1521, such that each outwardly-projecting end 1530 is configured to engage a respective indentation 1522 of the scalloped surfaces 1521 to set a length or height of the arm 200, which can be measured with respect to the arm axis 210. An optional collar 410 (FIG. 4) can be attached to the top of the lower body 212 to prevent the upper body 211 from becoming detached from the lower body 212.

Figure 17:
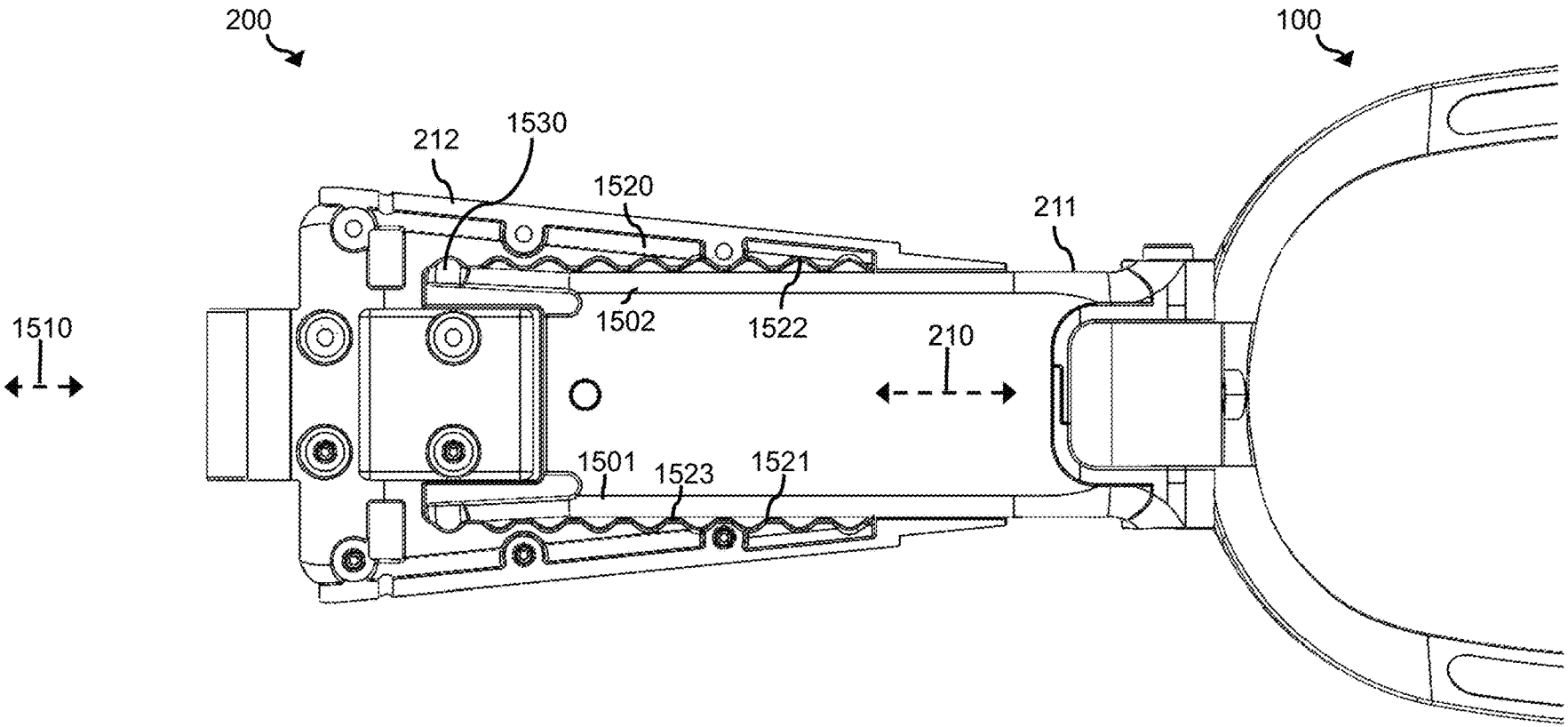
FIG. 17 is a top view of the arm with the housing removed to illustrate the telescoping upper and lower bodies in a contracted state.

The scalloped surfaces 1521 are curved to allow the outwardly-projecting ends 1530 to slide between neighboring indentations 1522 when sufficient lateral force is applied along the arm axis 210, such as by the user's hands, to adjust the length or height of the arm 200. The first and second fingers 1501, 1502 are pushed inwardly when the outwardly-projecting ends 1530 are disposed on the rounded ridges 1523 between the indentations 1522 (e.g., in an alternating pattern of indentations 1522 and rounded ridges 1523), which causes the first and second fingers 1501, 1502 to apply a force outwardly towards the respective internal walls 1520. The curve of the rounded ridges 1523 causes the outwardly-projecting ends 1530 to slide towards the indentations 1522 when the lateral force is released. For example, the upper body 211 can be pushed towards the lower body 212 such that the upper and lower bodies 211, 212 are in a contracted state, as illustrated in FIG. 17. The length or height of the arm 200 is smaller in the contracted state than in the expanded state.

Figure 18:
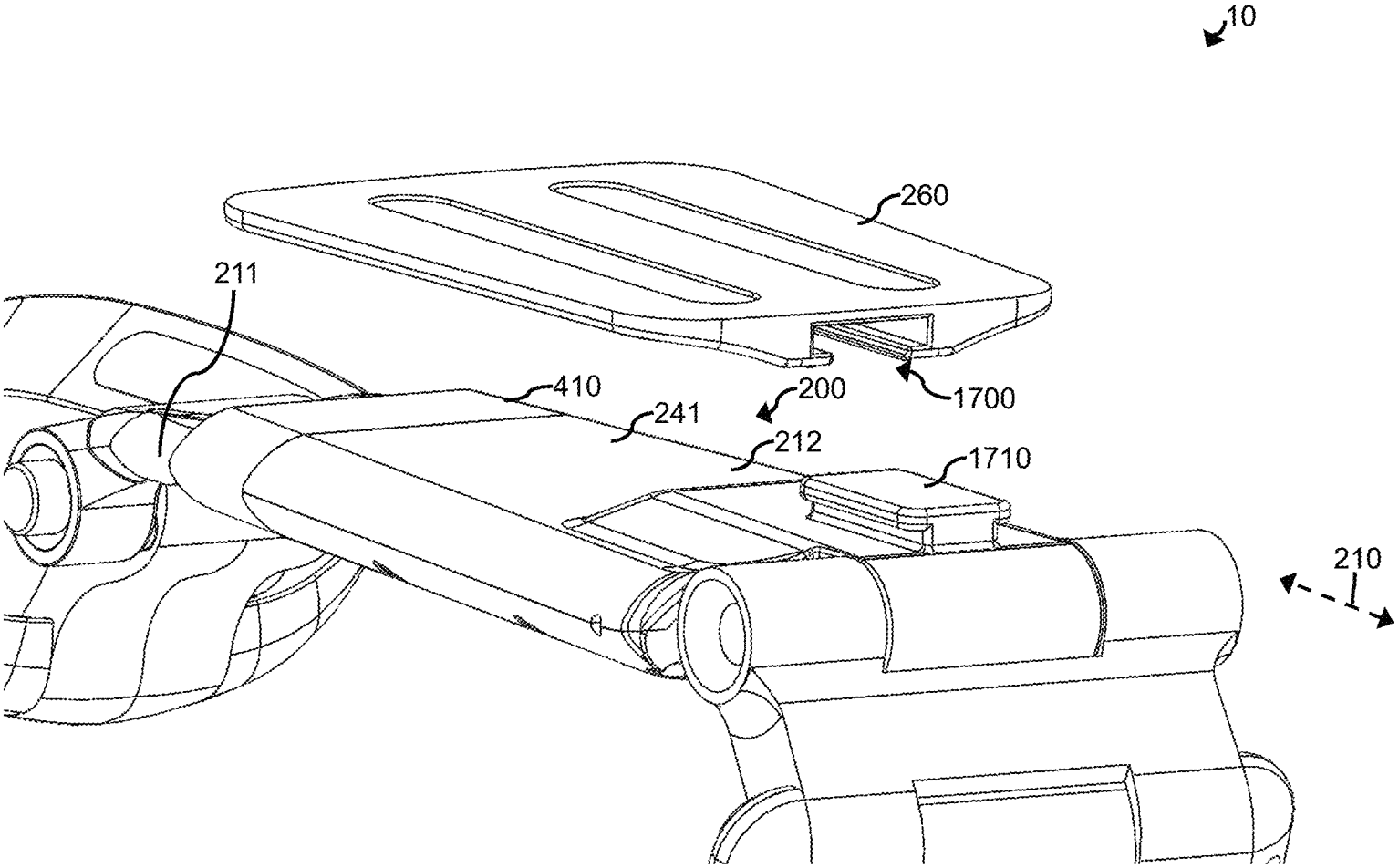
FIG. 18 is a partial-exploded view of the apparatus to further illustrate the adjustability of the chest support plate.
Figure 19:
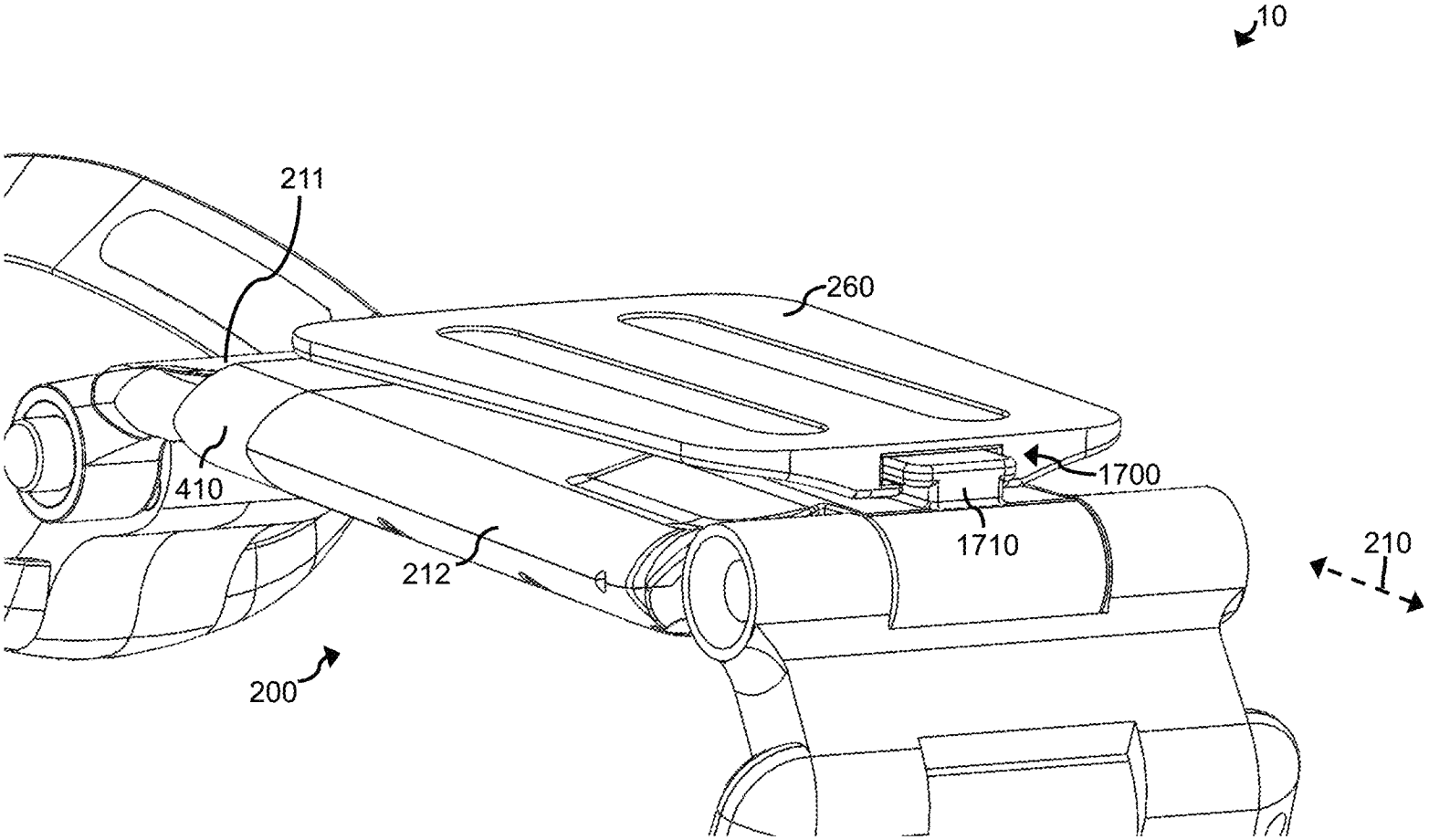
FIG. 19 is a lower-perspective view of the apparatus to further illustrate the adjustability of the chest support plate.

FIG. 18 is a partial-exploded view of the apparatus 10 to further illustrate the adjustability of the chest support plate 260. A slot 1700 (e.g., a chest support plate slot) is defined on the back surface in the chest support plate 260 that is configured to engage a ridge 1710 on the lower body 212 of the arm 200, as illustrated in FIG. 19. The ridge 1710 can have a T-shape in cross section. The slot 1700 and the ridge 1710 extend parallel to the arm axis 210. The position of the chest support plate 260 with respect to the arm 200 is adjustable with respect to the arm axis 210. When the chest support plate 260 is moved along the arm axis 210, the slot 1700 slides over the ridge 1710. The ridge 1710 is disposed on a front or proximal side 241 of the arm 200.

Figure 20:
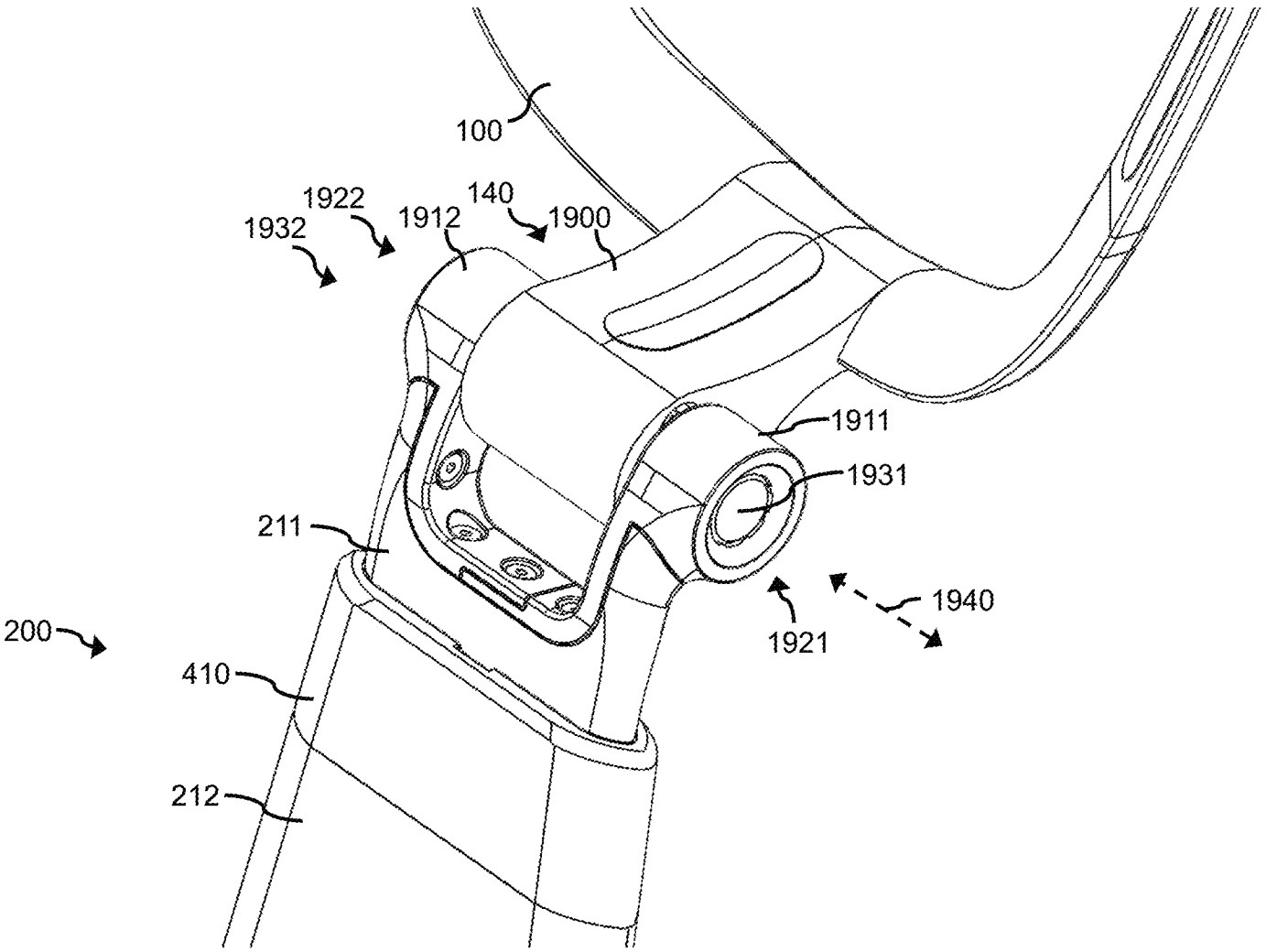
FIG. 20 is a perspective view of the bridge that pivotably couples the faceplate to the arm.

FIG. 20 is a perspective view of the bridge 140 that pivotably couples the faceplate 100 to the arm 200. The bridge 140 includes a bridge housing 1900, a hub 2000 (discussed below), and first and second buttons 1931, 1932 (discussed below). The bridge housing 1900 is mechanically coupled to the faceplate 100. In some embodiments, the faceplate 100 can include the bridge housing 1900. The bridge housing 1900 is pivotably coupled to first and second faceplate support bodies 1911, 1912 on the upper body 211 of the arm 200. In some embodiments, the upper body 211 includes the faceplate support bodies 1911, 1912. For example, the faceplate support bodies 1911, 1912 can be integrally formed with and/or integrally attached to the upper body 211. In other embodiments, the upper body 211 and the faceplate support bodies 1911, 1912 are separate structures that can be attached and/or connected together.

The faceplate support bodies 1911, 1912 have respective button holes 1921, 1922 that are configured to receive respective buttons 1931, 1932. The button holes 1921, 1922 extend into and/or out of the faceplate support bodies 1911, 1912 parallel to a pivot axis 1940, which can be parallel to the second axis 820.

Figure 21:
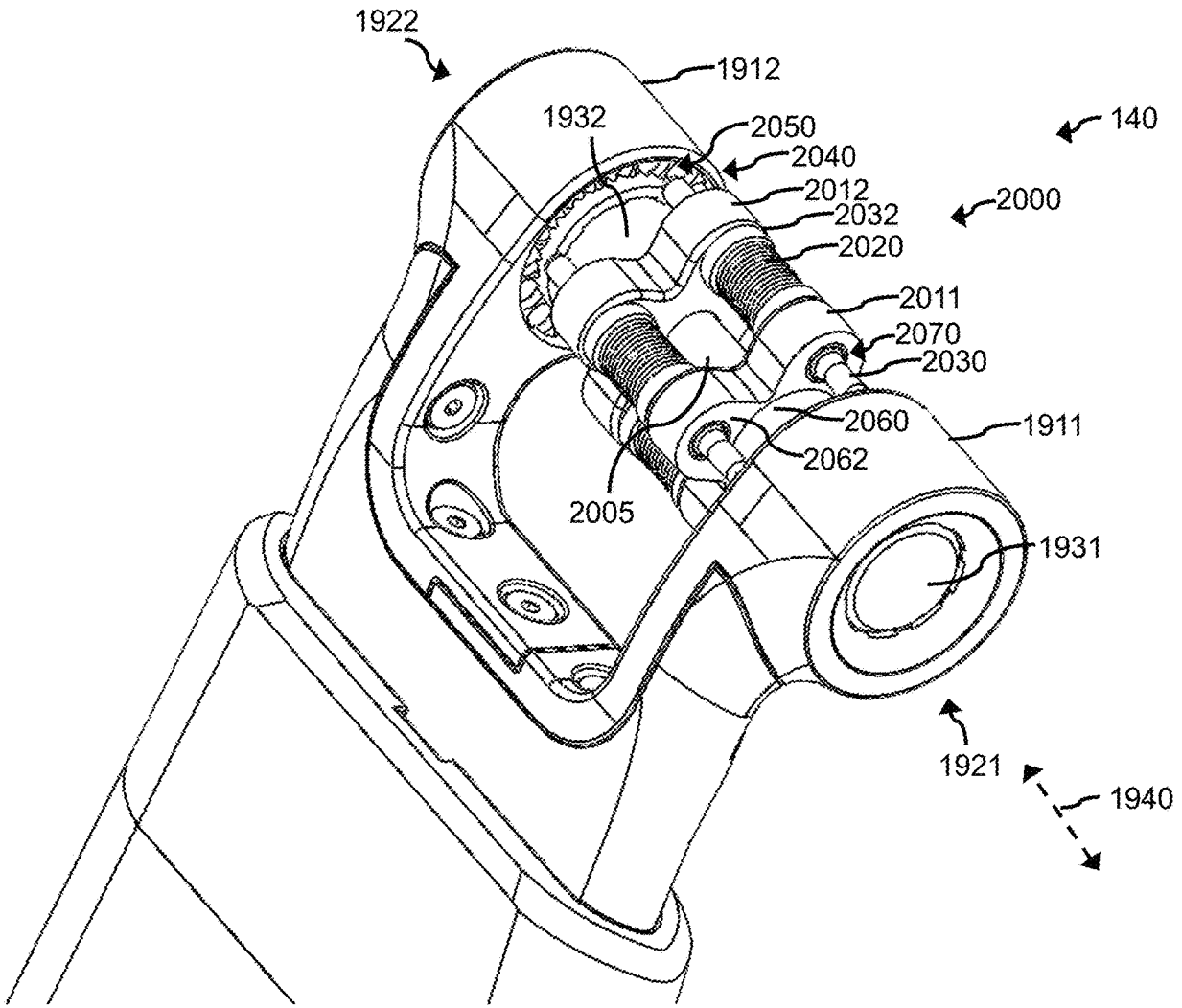
FIG. 21 is a perspective view of the bridge with the bridge housing removed with the first and second buttons in a depressed state.

FIG. 21 is a perspective view of the bridge 140 with the bridge housing 1900 removed to reveal a hub 2000 disposed between the faceplate support bodies 1911, 1912. The bridge housing 1900 is mechanically coupled to the hub 2000. The hub 2000 includes first and second hub bodies 2011, 2012 and one or more springs 2020 disposed between the hub bodies 2011, 2012. At least one locking pin 2030 is disposed in a respective locking pin hole 2070 defined in the respective hub body 2011, 2012. The locking pin holes 2070 extend through the hub bodies 2011, 2012 parallel to the pivot axis 1940, and allow the respective locking pins 2030 to slide parallel to the pivot axis 1940 (e.g., into and out of the locking pin holes 2070). Each locking pin 2030 has a flange or head 2032 that has a diameter that is larger than the diameter of the locking pin holes 2070. The flange 2032 is on the inner side of the hub bodies 2011, 2012.

The locking pins 2030 and the springs 2020 have respective lengths that are parallel to and that extend parallel to the pivot axis 1940 (e.g., from the outer surface of the respective hub body 2011, 2012 toward an inner side of each hub body 2011, 2012). An inner end 2060 of each button 1931, 1932 is disposed on (e.g., in direct physical contact with) the outer side 2062 of each hub body 2011, 2012. In some embodiments, the buttons 1931, 1932 and respective hub bodies 2011, 2012 can be integrally connected and/or integrally formed, such as in a single structure.

Each hub body 2011, 2012 includes a respective pivot adjustment ring 2040. Each pivot adjustment ring 2040 is located on the inner side of each hub body 2011, 2012 (e.g., the inner side of each hub body 2011, 2012 is closer to the hub 2000 than the outer side of each hub body 2011, 2012). The pivot adjustment rings 2040 are oriented such that the pivot axis 1940 passes through their centers. Each pivot adjustment ring 2040 includes a plurality of pivot adjustment holes 2050 that are spaced along the circumference of the adjustment ring 2040. The pivot adjustment holes 2050 are preferably regularly spaced along the circumference of the adjustment ring 2040. In other embodiments, the pivot adjustment holes 2050 can be irregularly spaced along the circumference of the adjustment ring 2040 or a combination of regularly spaced and irregularly spaced along the circumference of the adjustment ring 2040. Each pivot adjustment hole 2050 is oriented and extends parallel to the pivot axis 1940 and is sized to slidingly receive a locking pin 2030. The pivot adjustment holes 2050 have a cross-sectional shape (e.g., in a cross-sectional plane orthogonal to the pivot axis 1940) that is complementary to the cross-sectional shape of the locking pins 2030. In a preferred embodiment, the pivot adjustment holes 2050 and the locking pins 2030 have circular cross sections. In other embodiments, the pivot adjustment holes 2050 and the locking pins 2030 can have an oval, rectangular, or other cross sections.

A shaft 2005 extends along the pivot axis 1940 and can be mechanically coupled to the first and second buttons 1931, 1932. The shaft 2005 passes through a respective hole in the center of each hub body 2011, 2012, which allows the hub bodies 2011, 2012 to rotate about and slide along the pivot axis 1940. In addition, the ends of the shaft 2005 are disposed in respective holes defined in the inner side of each button 1931, 1932, which allow the buttons 1931, 1932 to slide (e.g., pushed in or out) over the shaft 2005 parallel to the pivot axis 1940.

It is noted that the pivot adjustment ring 2040 on the first faceplate support body 1911 and the second button hole 1922 are not viewable in FIG. 21 due to the perspective of the illustration.

Figure 22:
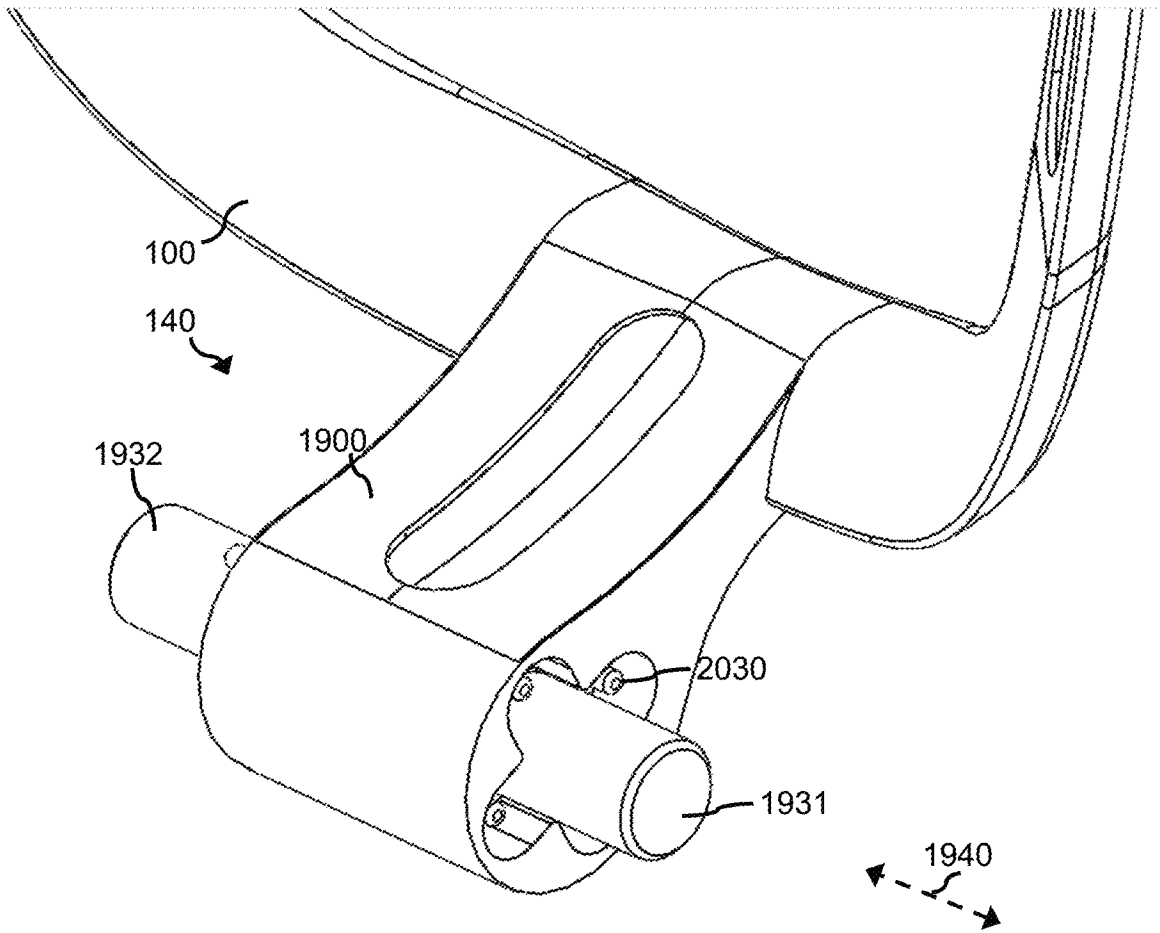
FIG. 22 is a perspective view of the bridge, with the faceplate support bodies removed, and the faceplate with the first and second buttons in the depressed state.

In operation, the buttons 1931, 1932 have a depressed state and a released state. In the depressed state, the buttons 1931, 1932 are pushed inwardly (e.g., towards the hub 2000), which causes the hub bodies 2011, 2012 to move inwardly (e.g., over shaft 2005). When the hub bodies 2011, 2012 move inwardly, the hub bodies 2011, 2012 press on the flange 2032 of the locking pins 2030. The flange 2032 of each locking pin 2030 is pressed against a respective spring 2020, which causes the springs 2020 to transition to a compressed state, as illustrated in FIGS. 21 and 22. The buttons 1931, 1932 can be manually pressed inwardly, such as by the user's hand(s), to create a manual force. When the hub bodies 2011, 2012 press on the flange 2032 of each locking pin 2030, the locking pins 2030 slide inwardly and out of the respective pivot adjustment holes 2050, such that the locking pins 2030 are separated and/or removed from the respective pivot adjustment holes 2050. When the locking pins 2030 are separated and/or removed from the respective pivot adjustment holes 2050, the hub 2000 is in an unlocked state where the hub 2000 can rotate with respect to the pivot axis 1940. Since the bridge housing 1900 is attached to the hub 2000, rotating the hub 2000 causes the bridge housing 1900 and the faceplate 100 to pivot with respect to the pivot axis 1940.

Figure 23:
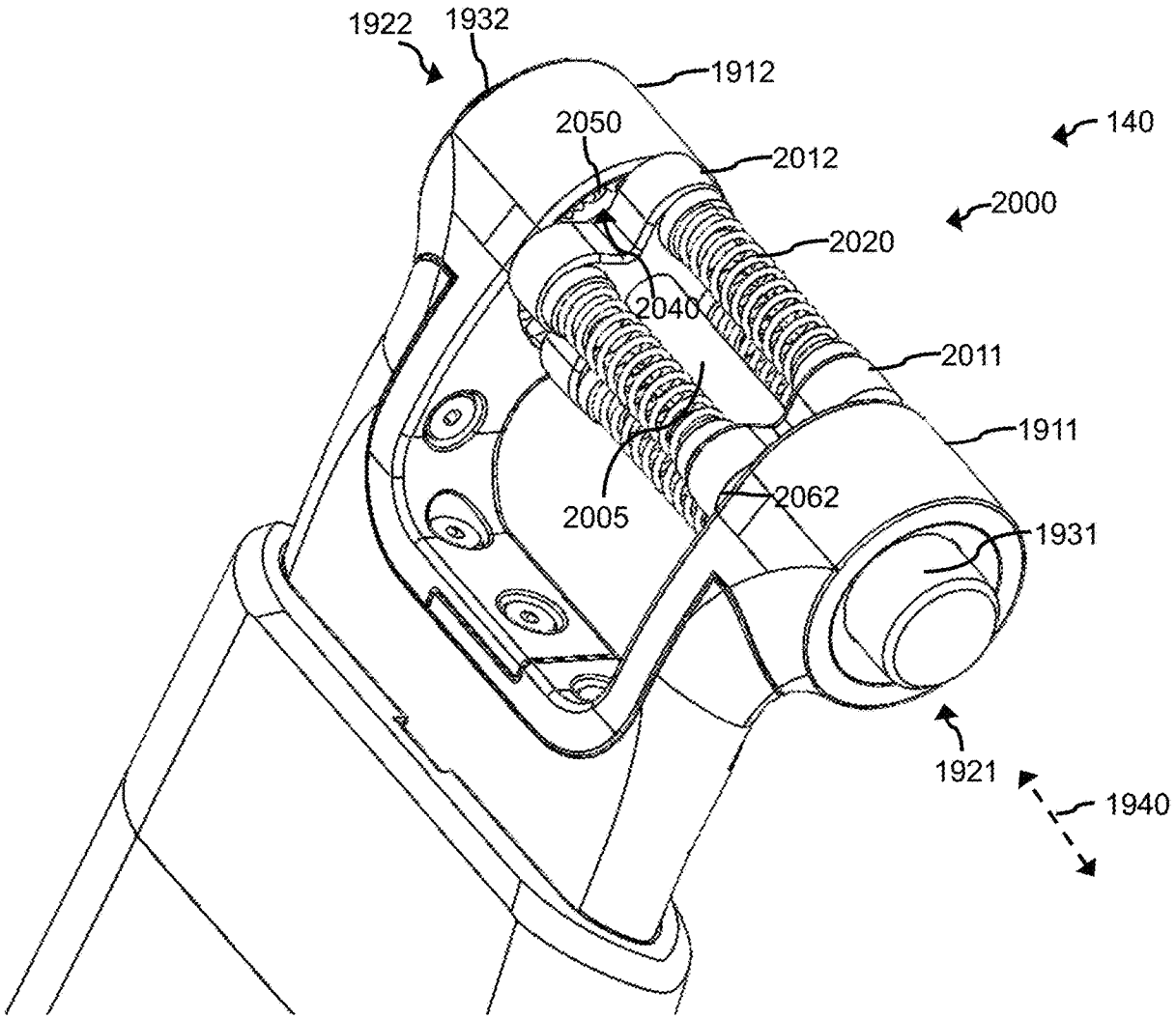
FIG. 23 is a perspective view of the bridge with the bridge housing removed with the first and second buttons in a released state.
Figure 24:
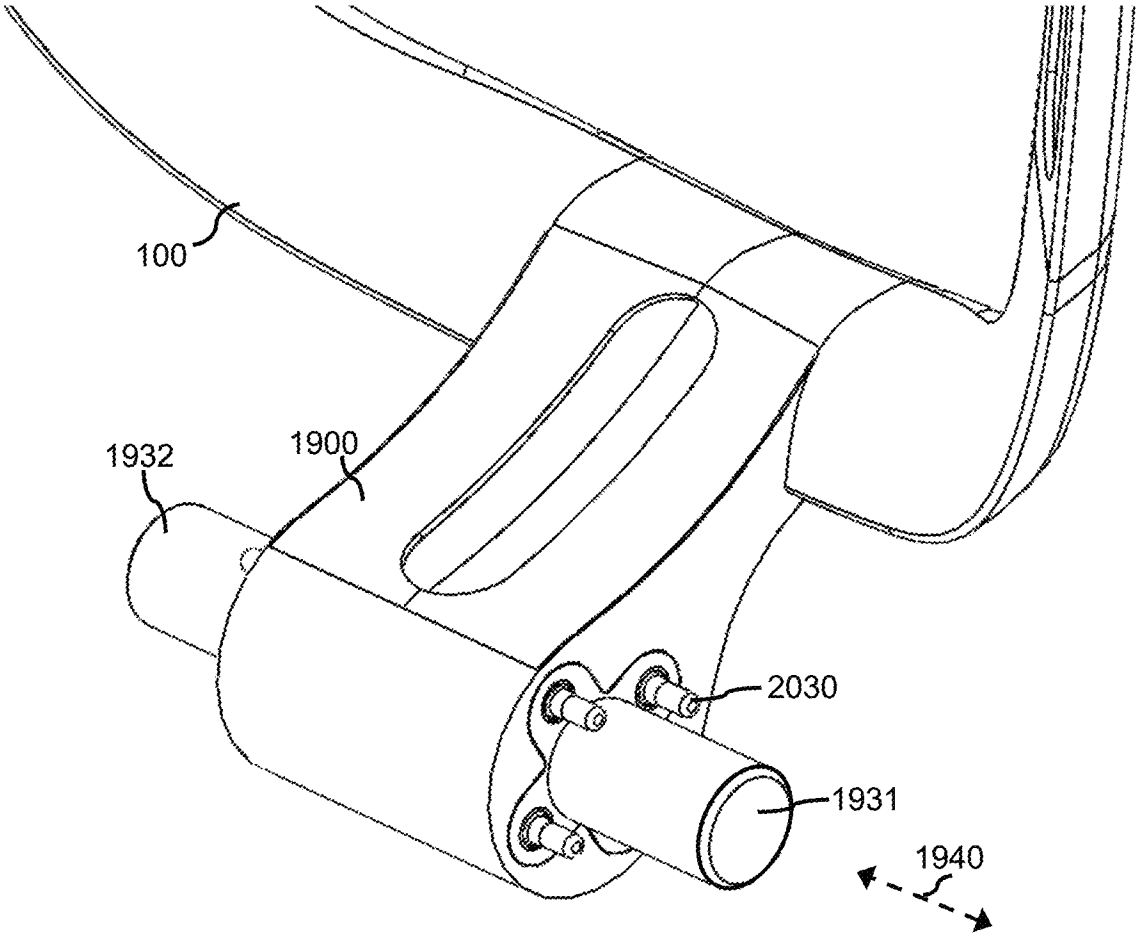
FIG. 24 is a perspective view of the bridge, with the faceplate support bodies removed, and the faceplate with the first and second buttons in the released state.

In the released state, the springs 2020 transition from the compressed state to an expanded state since the buttons 1931, 1932 are no longer pushed inwardly, as illustrated in FIGS. 23 and 24. Expanding the springs 2020 generates an outward force (e.g., towards the faceplate support bodies 1911, 1912) that causes the hub bodies 2011, 2012 and the locking pins 2030 to move outwardly (e.g., towards the faceplate support bodies 1911, 1912 and over the shaft 2005). For example, the springs 2020 generate an outward force (e.g., a bias) on the flange 2032 of each locking pin 2030, which causes the locking pins 2030 to move outwardly with the hub bodies 2011, 2012 such that one or more of the locking pins 2030 is/are inserted into and engage the respective pivot adjustment holes 2050. When the locking pin(s) 2030 is/are inserted into the respective pivot adjustment hole(s) 2050, the hub 2000 is in a locked state and cannot rotate with respect to the pivot axis 1940, thus locking the pivot position of the bridge housing 1900 and the faceplate 100. Expanding the springs 2020 also causes the buttons 1931, 1932 to move outwardly through the button holes 1921, 1922.

In some embodiments, each hub body 2011, 2012 can have 4 locking pins 2030. The locking pins 2030 can be arranged in pairs. The locking pins 2030 in each pair can be oriented on opposing sides of the center of the respective hub body 2011, 2012, where the pivot axis 1940 passes through the center of each hub body 2011, 2012. The pairs of locking pins 2030 can be angularly offset with respect to the pivot adjustment holes 2050 such that when a first pair of locking pins 2030 is aligned with corresponding pivot adjustment holes 2050, a second pair of locking pins 2030 is not aligned with any pivot adjustment holes 2050. Instead, the second pair of locking pins 2030 is aligned with the wall or body of the pivot adjustment ring 2040 in the space between neighboring pivot adjustment holes 2050. This configuration allows the faceplate 100 to be pivoted with a finer (e.g., higher) degree of angular resolution (e.g., twice the angular resolution than when there is only one pair of locking pins 2030 that is not angularly offset).

Figure 25:
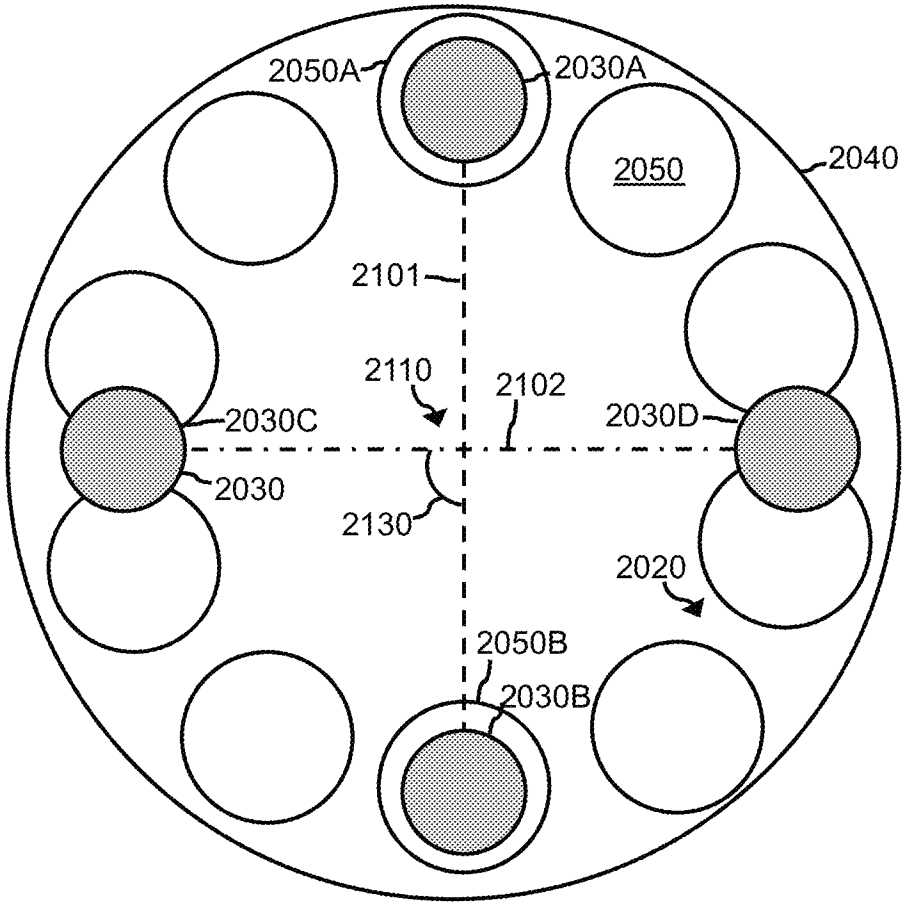
FIG. 25 is a projection of two pairs of locking pins on the pivot adjustment holes in which the locking pins are in a first state, according to an embodiment.

FIG. 25 is a projection of two pairs of locking pins 2030 on the pivot adjustment holes 2050 according to an embodiment. The first pair of locking pins 2030A, 2030B is aligned along a first axis 2101 (e.g., a first locking pin axis) that passes through a center of the hub body (e.g., hub body 2011, 2012). The center of the hub body is aligned with the center 2110 of the pivot adjustment ring 2040. The pivot axis 1940 passes through the center 2110 of the pivot adjustment ring 2040 and through the center of the hub bodies 2011, 2012, as discussed above. The pivot axis 1940 is orthogonal to the first and second axes 2101, 2102.

The second pair of locking pins 2030C, 2030D is aligned along a second axis 2102 (e.g., a second locking pin axis) that passes through the center of the hub body (e.g., hub body 2011, 2012). The first and second axes 2101, 2102 are angularly offset (e.g., not collinear) such that when the first pair of locking pins 2030A, 2030B is aligned with and insertable into corresponding pivot adjustment holes 2050A, 2050B, the second pair of locking pins 2030C, 2030D is not aligned with (and not insertable into) any pivot adjustment holes 2050. Instead, the second pair of locking pins 2030C, 2030D is aligned with the body and/or wall 2020 of the pivot adjustment ring 2040 between neighboring pivot adjustment holes 2050. The first and second axes 2101, 2102 are orthogonal to the pivot axis 1940.

Figure 26:
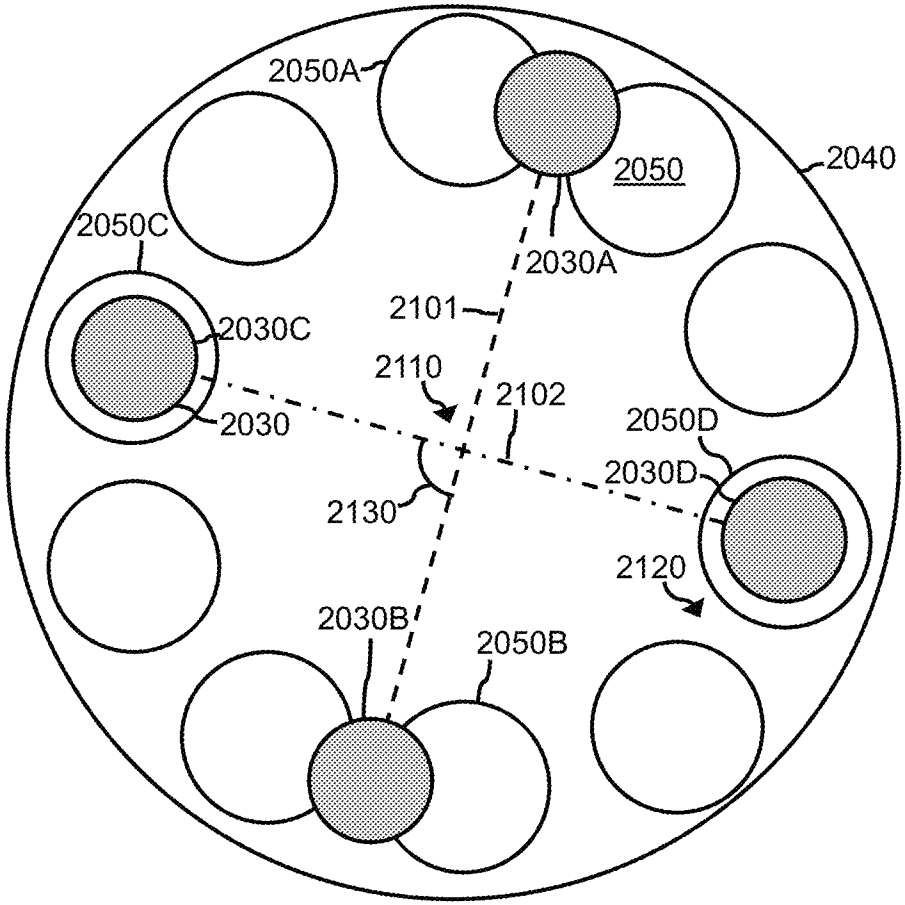
FIG. 26 is a projection of two pairs of locking pins on the pivot adjustment holes in which the locking pins are in a second state, according to an embodiment.

FIG. 25 illustrates a first state of the locking pins 2030 in which the first pair of locking pins 2030A, 2030B is aligned with and insertable into corresponding pivot adjustment holes 2050A, 2050B, and the second pair of locking pins 2030C, 2030D is not aligned with any pivot adjustment holes 2050. FIG. 26 illustrates a second state of the locking pins 2030 in which the first pair of locking pins 2030A, 2030B is not aligned with and insertable into any pivot adjustment holes 2050, and the second pair of locking pins 2030C, 2030D is aligned with and insertable into corresponding pivot adjustment holes 2050C, 2050D. The hub bodies 2011, 2012 are rotated about the pivot axis 1940 to transition from the first state to the second state. Rotating the hub bodies 2011, 2012 (e.g., to different rotational positions) causes the bridge housing 1900 and the faceplate 100 to pivot about the pivot axis 1940.

The first and second axes 2101, 2102 have an offset angle 2130 of 90°. In other embodiments, the offset angle 2130 can be another value. In general, the pivot adjustment ring 2040 includes N pivot adjustment holes 2050, where N is a positive even integer from 1 to 20 or another value. Each pivot adjustment hole 2050 is angularly spaced along the perimeter (e.g., circumference) of the pivot adjustment ring 2040 by 360°/N (e.g., when the angular spacing is equal). The angular spacing between neighboring pivot adjustment holes 2050 can be determined by a respective axis that passes through the center of each pivot adjustment holes 2050 and the center 2110 of the pivot adjustment ring 2040. The offset angle 2130 between the first and second axes 2101, 2102 can be $$M \times \frac{360°}{2N}$$

where M is a positive odd integer that is less than N−1. For example, referring to the embodiment illustrated in FIGS. 25 and 26, there are 10 pivot adjustment holes 2050 (N=10) so the angular spacing of the pivot adjustment holes 2050 is 36°. The offset angle 2130 is 90° where M is equal to 5

$$\left(\text{i.e., } 5 \times \frac{360°}{2 \times 10} = 90°\right).$$

However, in other embodiments the offset angle 2130 can be 54° (i.e., M=3), 104° (i.e., M=5), etc.

When there are N pivot adjustment holes 2050 and only one pair of locking pins 2030 (e.g., only the first pair of locking pins 2030A, 2030B), the faceplate 100 can be pivoted with an angular resolution of 360°/N (e.g., in 36° increments in FIGS. 25 and 26). When there are N pivot adjustment holes 2050 and two pairs of angularly-offset locking pins 2030 (e.g., the first pair of locking pins 2030A, 2030B and the second pair of locking pins 2030C, 2030D), the faceplate 100 can be pivoted with an angular resolution of 360°/2N (e.g., in 18° increments in FIGS. 25 and 26).

Figure 27:
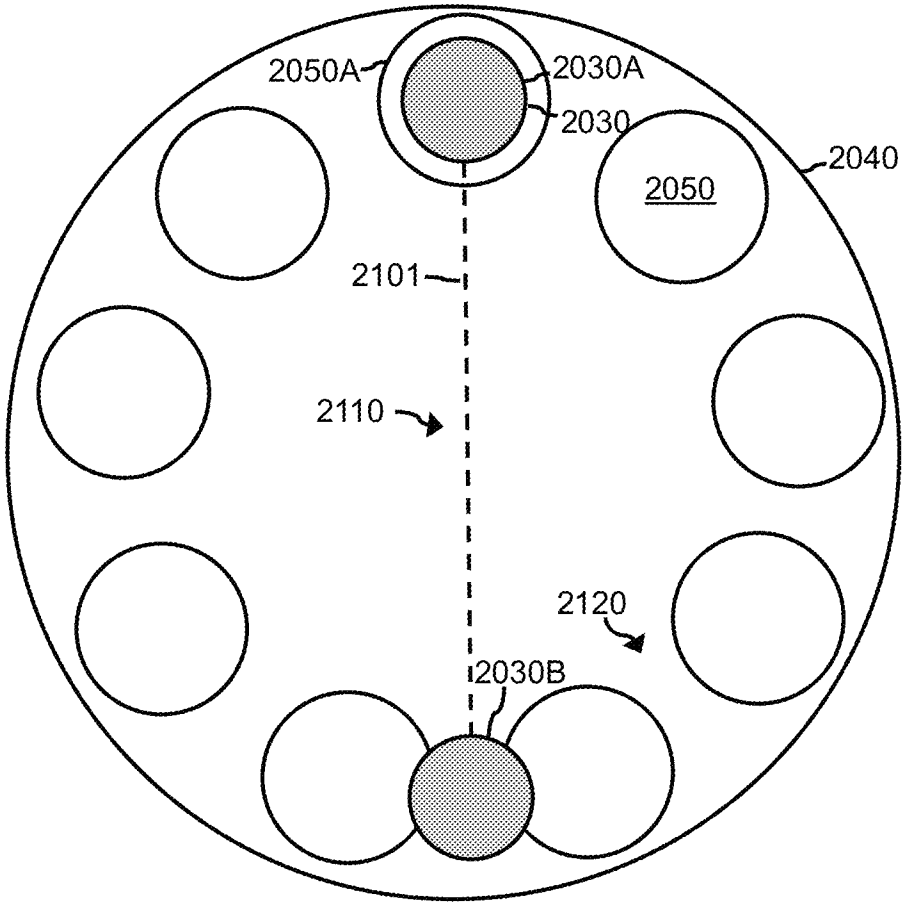
FIG. 27 is a projection of a pair of locking pins on the pivot adjustment holes in which the locking pins are in a first state, according to an alternative embodiment.
Figure 28:
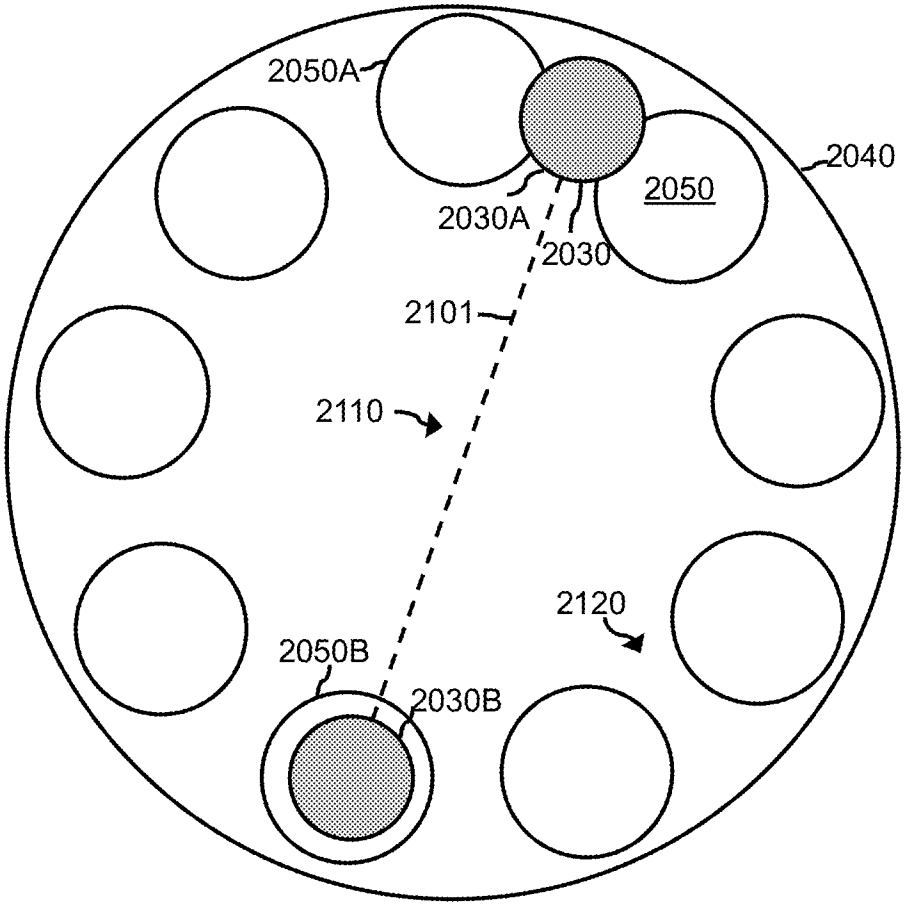
FIG. 28 is a projection of a pair of locking pins on the pivot adjustment holes in which the locking pins are in a second state, according to an alternative embodiment.

FIG. 27 is a projection of a pair of locking pins 2030A, 2030B on the pivot adjustment holes 2050 according to an alternative embodiment. FIG. 27 is the same as FIG. 25 except that in FIG. 27 there is only one pair of locking pins 2030A, 2030B and the pivot adjustment ring 2040 includes 9 pivot adjustment holes 2050. Since N is an odd positive integer in this embodiment, only one of the locking pins 2030A, 2030B can be aligned with and insertable into a corresponding pivot adjustment hole 2050 at any one time. For example, in the first state illustrated in FIG. 27, locking pin 2030A is aligned with and insertable into corresponding pivot adjustment hole 2050A and locking pin 2030B is aligned with the body and/or wall 2020 of the pivot adjustment ring 2040 between neighboring pivot adjustment holes 2050. Locking pin 2030B is not aligned with and insertable into any of the adjustment holes 2050 in the first state. In the second state, locking pin 2030A is aligned with the body and/or wall 2020 of the pivot adjustment ring 2040 between neighboring pivot adjustment holes 2050 and locking pin 2030B is aligned with and insertable into corresponding pivot adjustment hole 2050B, as illustrated in FIG. 28. Locking pin 2030A is not aligned with and insertable into any of the pivot adjustment holes 2050 in the second state.

In FIGS. 27 and 28, each pivot adjustment hole 2050 is angularly spaced along the perimeter or circumference of the pivot adjustment ring 2040 by 360°/N (e.g., when the angular spacing is equal) where N is a positive odd integer from 1 to 19 or another value. For example, referring to the embodiment illustrated in FIGS. 27 and 28, there are 9 pivot adjustment holes 2050 (N=9) so the angular spacing of the pivot adjustment holes 2050 is 40°. Since only one of the locking pins 2030A, 2030B can be aligned with and insertable into a corresponding pivot adjustment hole 2050 at any one time, the faceplate 100 can be pivoted with an angular resolution of 360°/2N (e.g., in 20° increments in FIGS. 27 and 28). Locking pins 2030A, 2030B are aligned along the first axis 2101 and thus have an angular offset of 180°.

An optional second pair of locking pins 2030C, 2030D (e.g., as illustrated in FIGS. 25 and 26) can be included in the embodiment illustrated in FIGS. 27 and 28. The second pair of locking pins 2030C, 2030D can be angularly offset (e.g., have an offset angle 2130) from the first pair of locking pins 2030A, 2030B by $$M \times \frac{360°}{2N}$$

where M is a positive even integer that is less than 2N−1.

Figure 1:
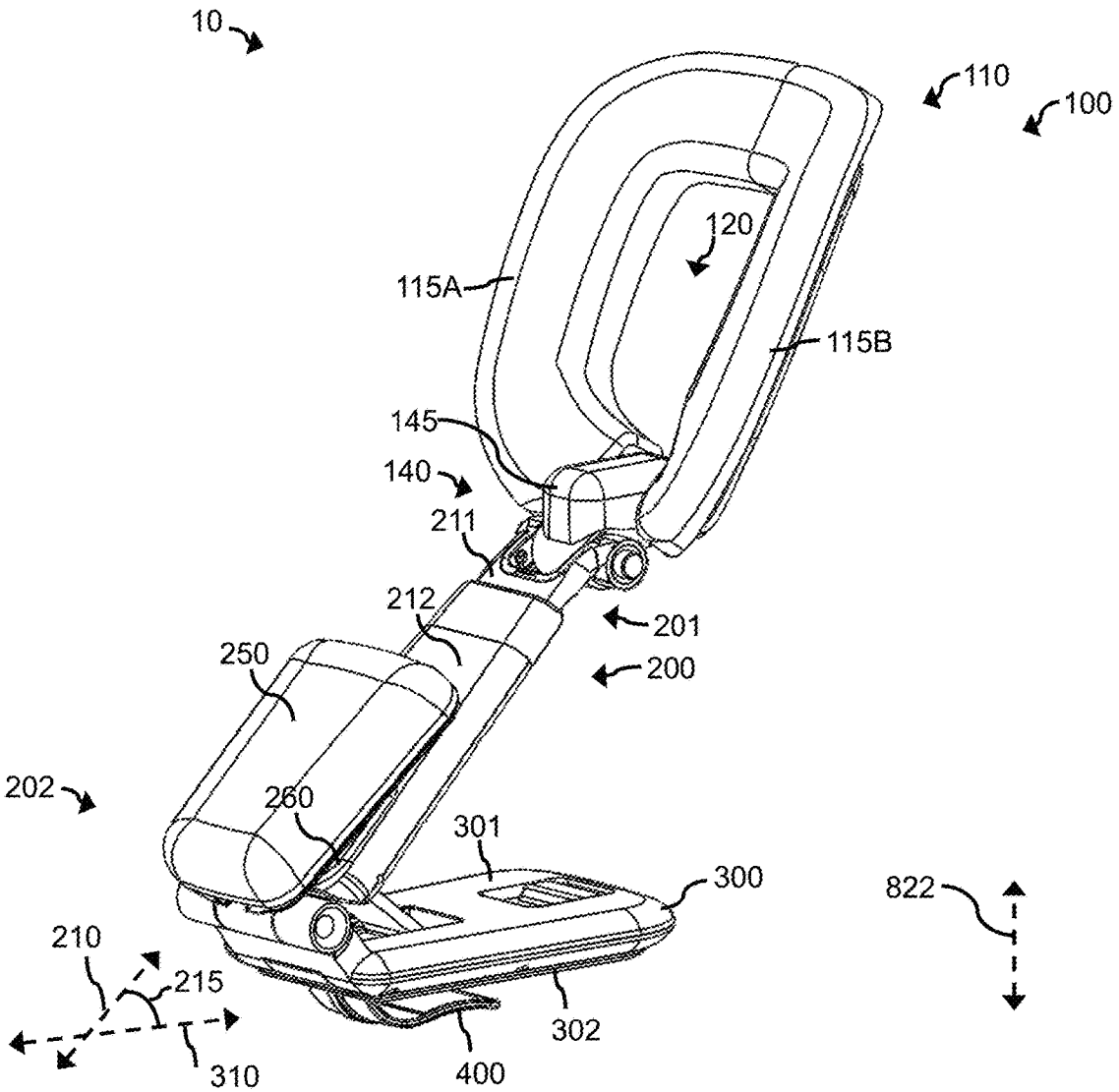
FIGS. 1-5 are perspective views of an apparatus for supporting a user in a forward-leaning position, according to an embodiment.

FIG. 29 is a perspective view of the apparatus 10 in a stowed state (e.g., an apparatus stowed state) according to an embodiment. When the raised button 930 is pushed distally to transition the base 300 from the locked state to the unlocked state, the arm 200 can be pivoted towards (or away from) and against the base 300. When the arm 200 is pivoted against the base 300, the arm 200 is in a stowed state (e.g., an arm stowed state), as illustrated in FIG. 29. When the arm 200 is in the stowed state, the arm axis 210 is parallel or substantially parallel (e.g., within +/−1-10° of or preferably within +/−5° of) the base axis 310. In addition, when the hub 2000 is in the unlocked state (e.g., when the first and second buttons 1931, 1932 are in the depressed state), the faceplate 100 can be pivoted towards (or away from) and against the arm 200. When the faceplate 100 is pivoted against the arm 200, the faceplate 100 is in a stowed state (e.g., a faceplate stowed state), as illustrated in FIG. 29. When the faceplate 100 and the arm 200 are in stowed states, the apparatus 10 is in a stowed state (e.g., an apparatus stowed state). The height of the apparatus 10, as measured with respect to a vertical axis such as the third axis 822, is smaller when the apparatus 10 is in the stowed state than when the apparatus 10 is in the deployed state (e.g., as illustrated in FIG. 1).

In a preferred embodiment, when the base 300 is in the unlocked state the base slide 740 is pushed into the slot 732 in the base body 730 when the apparatus 10 is in the stowed state to reduce a length of the base 300, which can be measured with respect to the base axis 310. In addition, the upper and lower bodies 211, 212 of the arm 200 are preferably in the contracted state when the apparatus 10 is in the stowed state to further reduce the size of the apparatus 10.

The invention should not be considered limited to the particular embodiments described above, but rather should be understood to cover all aspects of the invention as fairly set out in the attached claims. Various modifications, equivalent processes, as well as numerous structures to which the invention may be applicable, will be apparent to those skilled in the art to which the invention is directed upon review of this disclosure. The claims are intended to cover such modifications and equivalents.

What is claimed is:

1. An apparatus for supporting a user, comprising:

a faceplate having a frame that defines an opening configured to receive a user's face;

an arm having opposing first and second ends, the first end attached to the faceplate; and a base comprising:

a base body pivotably attached to the second end of the arm, the base body having a base body slot that extends from a distal end towards a proximal end of the base body along a first axis;

a lock bar disposed on the base body, the lock bar having a length that is parallel to the first axis and a width that is parallel to a second axis that is orthogonal to the first axis, the lock bar defining a plurality of holes that are spaced along the length of the lock bar, each said hole extending through the lock bar parallel to the second axis, the holes defined between opposing inner and outer sides of the lock bar;

a base slide configured to slidingly engage the base body slot, the base slide having a base slide lock pin; and a button body disposed on the base body and a top side of the lock bar, the button body including a button body slot that slidingly engages a lock bar pin that extends from the top side of the lock bar along a third axis that is orthogonal to the first and second axes, the button body slidable between a distal position and a proximal position, wherein the base has (a) a locked state in which the button body is in the proximal position and the base slide lock pin is inserted into one of the holes in the lock bar to prevent the base slide from sliding in the base body slot and (b) an unlocked state in which the button body is in the distal position and the base slide lock pin and the one of the holes in the lock bar are separated to allow the base slide to slide in the base body slot.

2. The apparatus of claim 1, wherein the button body slot is oriented in a direction between the first and second axes such that when the button body is in the proximal position, the lock bar is disposed closer to the base slide than when the button body is in the distal position, and when the button body is in the distal position, the lock bar is disposed further from the base slide than when the button body is in the proximal position.

3. The apparatus of claim 2, wherein:

a distal end of the button body slot is closer to a center axis of the base than a proximal end of the button body slot, when the button body is in the proximal position, the lock bar pin is in the distal end of the button body slot, and when the button body is in the distal position, the lock bar pin is in the proximal end of the button body slot.

4. The apparatus of claim 2, wherein the button body slot is straight.

5. The apparatus of claim 1, wherein the lock bar defines a row of the holes, the row parallel to the first axis.

6. The apparatus of claim 1, wherein a raised button is attached to the button body to allow the user to slide the button body parallel to the first axis.

7. The apparatus of claim 1, further comprising a spring attached to the button body and the base body, the spring extending parallel to the first axis, the spring having an expanded state when the button body is in the distal position and a contracted state when the button body is in the proximal position.

8. The apparatus of claim 1, further comprising:

a buttress having opposing first and second ends, the first end of the buttress pivotably attached to the arm, the second end of the buttress pivotably attached to the base; and a buttress pin guide disposed on the base body, the buttress pin guide having a buttress pin guide slot that extends parallel to the first axis, the buttress pin guide slot slidingly receiving a buttress lock pin attached at the second end of the buttress, the buttress lock pin extending parallel to the second axis, wherein:

the lock bar defines first and second rows of the holes, the first and second rows parallel to the first axis, and in the locked state, the base slide lock pin is inserted into one of the holes in the first row and the buttress lock pin is inserted into one of the holes in the second row.

9. The apparatus of claim 8, wherein in the unlocked state:

the base slide lock pin is removed from the one of the holes in the first row and the buttress lock pin is removed from the one of holes in the second row, and the buttress lock pin is slidable along the buttress pin guide slot to move the second end of the buttress along the first axis to thereby adjust an angle of the arm, the angle defined between an arm axis and the first axis, the arm axis extending along a length of the arm, the length measured between the first and second ends of the arm.

10. The apparatus of claim 1, wherein the arm is configured to telescope to adjust a length of the arm, the length measured between the first and second ends of the arm.

11. The apparatus of claim 10, wherein the arm includes upper and lower bodies, the upper body including first and second fingers that slidably contact opposing inner walls, respectively, in the lower body.

12. The apparatus of claim 11, wherein:

each said opposing inner wall has a scalloped surface comprising an alternating pattern of indentations and rounded ridges, and an outwardly-projecting end of each said finger and the indentations have complementary shapes.

13. The apparatus of claim 1, further comprising a chest support plate having a chest support plate slot defined on a back surface of the chest support plate, the chest support plate slot configured to slide over a ridge on the arm that extends along an arm axis, the arm axis extending along a length of the arm, the length measured between the first and second ends of the arm, whereby a position of the chest support plate along the arm axis is adjustable with respect to the arm.

14. The apparatus of claim 1, wherein the faceplate is pivotably attached to the first end of the arm.

15. An apparatus for supporting a user, comprising:

a faceplate having a frame that defines an opening to receive a user's face;

an arm having opposing first and second ends, the first end attached to the faceplate; and a base comprising:

a base body pivotably attached to the second end of the arm, the base body having a base body slot that extends from a distal end towards a proximal end of the base body along a first axis;

first and second lock bars disposed on the base body, each said lock bar having a length that is parallel to the first axis and a width that is parallel to a second axis that is orthogonal to the first axis, each said lock bar defining a plurality of holes that are spaced along the length of a respective lock bar, each said hole extending through the respective lock bar parallel to the second axis, the holes defined between opposing inner and outer sides of the respective lock bar;

a base slide configured to slidingly engage the base body slot, the base slide having first and second base slide lock pins; and a button body disposed on the base body and a top side of each said lock bar, the button body including a first body slot that slidingly engages a first lock bar pin that extends from the top side of the first lock bar parallel to a third axis that is orthogonal to the first and second axes, and a second body slot that slidingly engages a second lock bar pin that extends from the top side of the second lock bar parallel to the third axis, wherein:

a distal end of a respective button body slot is closer to a center axis of the base than a proximal end of the respective button body slot, the button body is slidable between a distal position and a proximal position, and the base has (a) a locked state in which the button body is in the proximal position, each said lock bar pin is in the distal end of the respective button body slot, and each said base slide lock pin is inserted into a respective hole in the respective lock bar to prevent the base slide from sliding in the base body slot and (b) an unlocked state in which the button body is in the distal position and each said base slide lock pin and the respective hole in the respective lock bar are separated to allow the base slide to slide in the base body slot.

16. The apparatus of claim 15, further comprising a spring attached to the button body and the base body, the spring extending parallel to the first axis, the spring having an expanded state when the button body is in the distal position and a contracted state when the button body is in the proximal position.

17. The apparatus of claim 16, wherein the spring generates a spring force in the expanded state that causes the button body to return to the proximal position when a manual force on the button body is removed.

18. An apparatus for supporting a user, comprising:

a faceplate having a frame that defines an opening to receive a user's face;

an arm having opposing first and second ends, the first end attached to the faceplate; and a base comprising:

a base body pivotably attached to the second end of the arm, the base body having a base body slot that extends from a distal end towards a proximal end of the base body along a first axis;

first and second lock bars disposed on the base body, each said lock bar having a length that is parallel to the first axis and a width that is parallel to a second axis that is orthogonal to the first axis, each said lock bar defining first and second rows of holes, the first and second rows parallel to the first axis, a base slide configured to slidingly engage the base body slot, the base slide having first and second base slide lock pins;

a button body disposed on the base body and a top side of each said lock bar, the button body including a first body slot that slidingly engages a first lock bar pin that extends from the top side of the first lock bar parallel to a third axis that is orthogonal to the first and second axes, and a second body slot that slidingly engages a second lock bar pin that extends from the top side of the second lock bar parallel to the third axis; and a buttress pin guide disposed on the base body, the buttress pin guide having a buttress pin guide slot that extends parallel to the first axis; and a buttress having opposing first and second ends, the first end of the buttress pivotably attached to the arm, the second end of the buttress pivotably attached to the base, the buttress including first and second buttress lock pins attached at the second end of the buttress and extending parallel to the second axis, the buttress pin guide slot slidingly receiving the buttress lock pins, wherein:

a distal end of a respective button body slot is closer to a center axis of the base than a proximal end of the respective button body slot, the center axis parallel to the first axis, the button body is slidable between a distal position and a proximal position, and the base has (a) a locked state in which the button body is in the proximal position, each said lock bar pin is in the distal end of the respective button body slot, each said base slide lock pin is inserted into a respective hole in a respective first row to prevent the base slide from sliding in the base body slot, and each said buttress lock pin is inserted into a respective hole in a respective second row to prevent the second end of the buttress from sliding parallel to the first axis in the buttress pin guide, and (b) an unlocked state in which the button body is in the distal position, each said base slide lock pin is separated from the respective hole in the respective first row to allow the base slide to slide in the base body slot, and each said buttress lock pin is separated from the respective hole in the respective second row to allow the second end of the buttress to slide parallel to the first axis in the buttress pin guide, thereby allowing the second end of the arm to pivot.

19. An apparatus for supporting a user, comprising:

a faceplate having a frame that defines an opening to receive a user's face;

an arm having opposing first and second ends, the first end attached to the faceplate; and a base comprising:

a base body pivotably attached to the second end of the arm, the base body having a length that extends from a distal end to a proximal end of the base body along a first axis;

first and second lock bars disposed on the base body, each said lock bar having a length that is parallel to the first axis and a width that is parallel to a second axis that is orthogonal to the first axis, each said lock bar defining a plurality of holes that are spaced along the first axis, a button body disposed on the base body and a top side of each said lock bar, the button body including a first body slot that slidingly engages a first lock bar pin that extends from the top side of the first lock bar parallel to a third axis that is orthogonal to the first and second axes, and a second body slot that slidingly engages a second lock bar pin that extends from the top side of the second lock bar parallel to the third axis; and a buttress pin guide disposed on the base body, the buttress pin guide having a buttress pin guide slot that extends parallel to the first axis; and a buttress having opposing first and second ends, the first end of the buttress pivotably attached to the arm, the second end of the buttress pivotably attached to the base, the buttress including first and second buttress lock pins attached at the second end of the buttress and extending parallel to the second axis, the buttress pin guide slot slidingly receiving the buttress lock pins, wherein:

a distal end of a respective button body slot is closer to a center axis of the base than a proximal end of the respective button body slot, the center axis parallel to the first axis, the button body is slidable between a distal position and a proximal position, and the base has (a) a locked state in which the button body is in the proximal position, each said lock bar pin is in the distal end of the respective button body slot, and each said buttress lock pin is inserted into a respective hole to prevent the second end of the buttress from sliding parallel to the first axis in the buttress pin guide, and (b) an unlocked state in which the button body is in the distal position, and each said buttress lock pin is separated from the respective hole to allow the second end of the buttress to slide parallel to the first axis in the buttress pin guide, thereby allowing the second end of the arm to pivot.

* * * * *